US012226065B2

(12) United States Patent
Wong et al.

(10) Patent No.: US 12,226,065 B2
(45) Date of Patent: Feb. 18, 2025

(54) DISH WASHING MACHINE WITH HEAT EXCHANGERS

(71) Applicant: K.D.W. Company Limited, Hong Kong (CN)

(72) Inventors: Kwok Din Wong, Hong Kong (CN); Li Zhou, Hong Kong (CN); Sai Hin Wong, Hong Kong (CN); Hang Yan Wong, Hong Kong (CN)

(73) Assignee: K.D.W. Company Limited, Hong Kong (CN)

( * ) Notice: Subject to any disclaimer, the term of this patent is extended or adjusted under 35 U.S.C. 154(b) by 278 days.

(21) Appl. No.: 17/697,586

(22) Filed: Mar. 17, 2022

(65) Prior Publication Data

US 2023/0292981 A1 Sep. 21, 2023

(51) Int. Cl.

| | |
|---|---|
| ***A47L 15/00*** | (2006.01) |
| ***A47L 15/42*** | (2006.01) |
| ***F28D 1/06*** | (2006.01) |
| ***F28D 7/10*** | (2006.01) |
| ***F28D 7/14*** | (2006.01) |
| ***F28D 21/00*** | (2006.01) |
| ***F28F 3/12*** | (2006.01) |
| ***F28F 3/14*** | (2006.01) |

(52) U.S. Cl.

CPC ..... *A47L 15/4291* (2013.01); *A47L 15/0076* (2013.01); *A47L 15/428* (2013.01); *F28D 1/06* (2013.01); *F28D 7/106* (2013.01); *F28D 7/14* (2013.01); *F28D 21/0012* (2013.01); *F28F 3/12* (2013.01); *F28F 3/14* (2013.01)

(58) Field of Classification Search

None

See application file for complete search history.

(56) References Cited

U.S. PATENT DOCUMENTS 5,331,986 A 7/1994 Lim et al.
5,453,131 A 9/1995 Chan et al.
(Continued)

FOREIGN PATENT DOCUMENTS

CN 1083692 A 3/1994
CN 1220129 A 6/1999
(Continued)

OTHER PUBLICATIONS

European Search Report issued by the European Patent Office in Application No. 18913495.0, dated Dec. 2, 2021 (16 pages).
(Continued)

*Primary Examiner* — Levon J Shahinian
(74) *Attorney, Agent, or Firm* — FLYNN THIEL, P.C.

(57) ABSTRACT

A dish washing machine including a housing having an interior wash space and a liquid inlet. A spray nozzle sprays the liquid onto dishes. The machine further includes a heating tank for heating the liquid which is supplied to the rotating spray nozzle. A heat exchange system transfers heat from the liquid heated by the heating tank to the liquid added from the liquid inlet. The heat exchange system comprising a pipe system defining a first path therethrough and a second path therethrough, with the first heat exchange system transferring heat from liquid in the second path to liquid in the first path. A first surface portion of the pipe system of the first path engaging the liquid in the first path having a greater thermal conductivity than a second surface portion of the pipe system of the second path engaging the liquid in the second path.

15 Claims, 20 Drawing Sheets

(56) References Cited

U.S. PATENT DOCUMENTS

| | | | |
|---|---|---|---|
| 5,660,193 | A | 8/1997 | Archer et al. |
| 8,679,261 | B2 | 3/2014 | Brunswick et al. |
| 9,078,555 | B2 | 7/2015 | Teisele et al. |
| 10,610,081 | B2 | 4/2020 | Disch et al. |
| 10,905,306 | B2 | 2/2021 | Wong et al. |
| 2010/0300499 | A1 | 12/2010 | Han et al. |
| 2012/0047961 | A1 | 3/2012 | Tarr et al. |
| 2013/0152981 | A1 | 6/2013 | Bertsch et al. |
| 2014/0338754 | A1 | 11/2014 | Nuti |
| 2016/0324390 | A1 | 11/2016 | Toga et al. |
| 2018/0256001 | A1 | 9/2018 | Wong et al. |
| 2019/0307307 | A1 | 10/2019 | Wong et al. |
| 2021/0228060 | A1 | 7/2021 | Wong et al. |

FOREIGN PATENT DOCUMENTS

| | | | |
|---|---|---|---|
| CN | 101229046 | A | 7/2008 |
| CN | 101862171 | A | 10/2010 |
| CN | 101961237 | A | 2/2011 |
| CN | 102458210 | A | 5/2012 |
| CN | 103519764 | A | 1/2014 |
| CN | 203524618 | U | 4/2014 |
| CN | 104939781 | A | 9/2015 |
| CN | 105615809 | A | 6/2016 |
| DE | 102013213970 | A1 | 2/2015 |
| DE | 102014217503 | A1 | 3/2016 |
| EP | 0689791 | A1 | 1/1996 |
| EP | 2292136 | A1 | 3/2011 |
| JP | 10-75926 | A | 3/1998 |
| JP | 2001-292944 | A | 10/2001 |
| JP | 2007-7178 | A | 1/2007 |
| JP | 2009-89941 | A | 4/2009 |
| JP | 2009-131512 | A | 6/2009 |
| TW | I441610 | B | 6/2014 |

OTHER PUBLICATIONS

Search Report of the International Searching Authority issued in PCT/CN2017/083098, date of mailing Dec. 14, 2017 (5 pages).
Written Opinion of the International Searching Authority issued in PCT/CN2017/083098, date of mailing Dec. 14, 2017 (4 pages).
Search Report of the International Searching Authority issued in PCT/CN2018/109245, date of mailing Jan. 9, 2019 (5 pages).
Written Opinion of the International Searching Authority issued in PCT/CN2018/109245, date of mailing Jan. 9, 2019 (6 pages).
Taiwan Office Action issued in Taiwan Patent Application No. 108124847, with English translation of Search Report, dated Aug. 18, 2020 (7 pages).
U.S. Appl. No. 17/540 743, filed Dec. 2, 2021.

DISH WASHING MACHINE WITH HEAT EXCHANGERS

FIELD OF THE INVENTION

This disclosure relates generally to the field of dish washing machines, and in particular to dish washing machines with heat exchangers.

BACKGROUND OF THE INVENTION

Commercial establishments for cooking and/or preparing food typically have a commercial dish washer for washing dirty dishes. The dish washers spray a detergent and water onto the dirty dishes to clean the dishes. The dish washers can also spray a rinse aid and water onto the dishes after the dishes have been washed to rinse the dishes and prevent spots on the dishes.

Currently, there are four main types of commercial dish washers in worldwide markets. The commercial dish washers include an under-counter dish washing machine, a hood or door type dish washing machine, a tunnel type dish washing machine and a flight type dish washing machine. The under-counter dish washing machine has a small size and low profile and is positioned under a separate work bench with a wash basin next to the space occupied by the under-counter dish washing machine. The hood or door type dish washing machine, the tunnel type dish washing machine and the flight type dish washing machine all have a medium to large size and are positioned next to a separate side bench with a wash basin on the bench. The under-counter dish washing machine, the hood or door type dish washing machine and the tunnel type dish washing machine all typically use a rack or container having the dirty dishes that is positioned within the machine. The flight type dish washing machine has dishes that are put directly onto an integral conveyor and washed as the dishes pass therethrough.

A more efficient and environmentally friendly commercial dish washer is desired.

SUMMARY OF THE INVENTION

The present invention, according to one aspect, is directed to a dish washing machine comprising a housing having an interior wash space for washing dishes, with the housing having a liquid inlet for adding a liquid to the dish washing machine and a liquid outlet for removing dirty liquid from the dish washing machine. The dish washing machine further includes at least one spray nozzle for spraying the liquid onto dishes positioned within the interior wash space and a heating tank for heating the liquid which is supplied to the at least one spray nozzle for spraying onto the dishes in the interior wash space. At least one heat exchange system is within the housing, with the at least one heat exchange system transferring heat from the liquid heated by the heating tank to the liquid added to the dish washing machine from the liquid inlet. The at least one heat exchange system includes a first heat exchange system comprising a pipe system defining a first path therethrough and a second path therethrough, with the first heat exchange system transferring heat from liquid in the second path to liquid in the first path. The first path is located between the liquid inlet and the heating tank. The second path is located between a drain for the interior wash space and the liquid outlet of the housing. A first surface portion of the pipe system of the first path engaging the liquid in the first path has a greater thermal conductivity than a second surface portion of the pipe system of the second path engaging the liquid in the second path.

Yet another aspect of the present invention is to provide a dish washing machine comprising a housing having an interior wash space for washing dishes, with the housing having a liquid inlet for adding a liquid to the dish washing machine and a liquid outlet for removing dirty liquid from the dish washing machine. The dish washing machine also includes at least one spray nozzle for spraying the liquid onto dishes positioned within the interior wash space and a heating tank for heating the liquid which is supplied to the at least one spray nozzle for spraying onto the dishes in the interior wash space. At least one heat exchange system is within the housing, with the at least one heat exchange system transferring heat from the liquid heated by the heating tank to the liquid added to the dish washing machine from the liquid inlet. The at least one heat exchange system includes a first heat exchange system comprising a pipe system comprising an inner pipe and an outer pipe, the pipe system defining a first path between the inner pipe and the outer pipe, the pipe system also defining a second path within the inner pipe, with the first heat exchange system transferring heat from liquid in the second path to liquid in the first path. The first path is located between the liquid inlet and the heating tank. The second path is located between a drain for the interior wash space and the liquid outlet of the housing. An outer surface of the inner pipe has a greater thermal conductivity than an inner surface of the inner pipe.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

Figure 1:
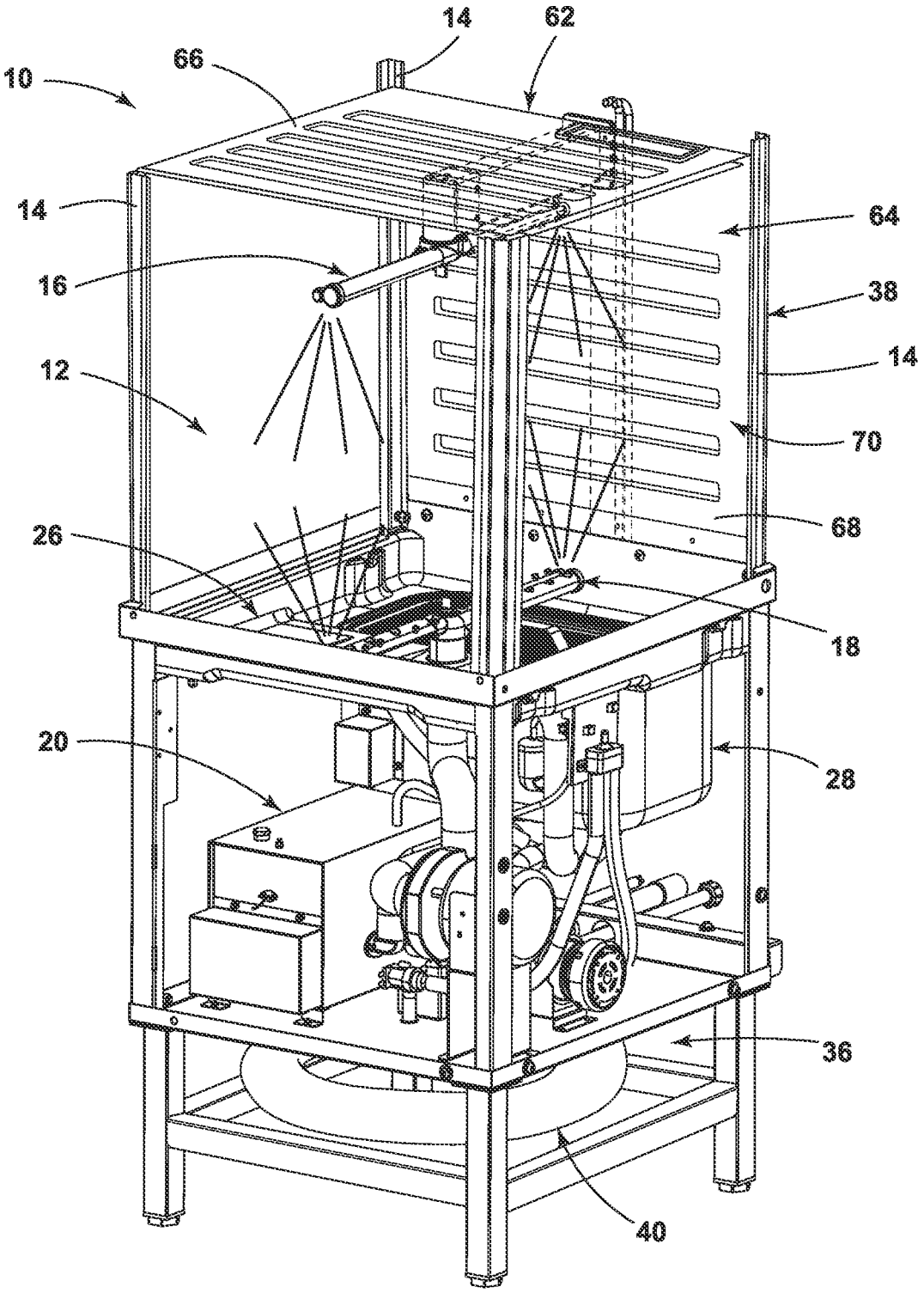
FIG. 1 is a front perspective view of a dish washing machine according to an embodiment with walls and a door removed for reference.

Certain terminology will be used in the following description for convenience in reference only and will not be limiting. Said terminology will include the words specifically mentioned, derivatives thereof, and words of similar import.

DETAILED DESCRIPTION

Reference will now be made in detail to implementations and embodiments of various aspects and variations of the invention, examples of which are illustrated in the accompanying drawings. Although at least two variations of the systems, methods and uses are described, other variations of the systems, methods and uses may include aspects of the systems, methods and uses described herein combined in any suitable manner having combinations of all or some of the aspects described.

FIGS. 1-6 illustrate an embodiment of a dish washing machine 10. The dish washing machine 10 includes an interior wash space 12 for accepting dishes (e.g., glasses, plates, eating and serving utensils, etc.) for cleaning the dishes. While not shown, the interior wash space 12 can include at least one shelf or ledge as is known to those skilled in the art for directly holding the dishes or holding a tray or rack holding the dishes. In FIGS. 1-6, exterior walls of the dish washing machine 10 are not shown in order to be able to view the interior of the dish washing machine 10. It is contemplated that the dish washing machine 10 can include at least one door for selectively accessing the interior wash space 12 of the dish washing machine 10 and enclosing the interior wash space 12 of the dish washing machine 10 during use. For example, a door can be connected to a wall to selectively open the dish washing machine 10 (e.g., a rotatable door) or wall(s) (not shown) can be slid upward along posts 14 of the dish washing machine 10 to allow access to the interior wash space 12 of the dish washing machine 10 and slid back down into position to enclose the interior wash space 12 of the dish washing machine 10 during use.

In the illustrated example, the interior wash space 12 of the dish washing machine 10 includes a top rotating spray arm 16 located at a top of the interior wash space 12 for positioning above the dishes (and possibly the tray or rack) along with a bottom rotating spray arm 18 located at a bottom of the interior wash space 12 and below the dishes (and possibly the tray or rack) for spraying water, a washing fluid and/or a rinsing fluid onto the dishes to clean the dishes. Water in a booster heating tank 20 is supplied to the top rotating spray arm 16 and the bottom rotating spray arm 18 to wash and rinse the dishes.

Systems for supplying the water to the interior wash space 12 of the dish washing machine 10 via the top rotating spray arm 16 and the bottom rotating spray arm 18 are well known to those skilled in the art and any such system can be used. For example, the system for supplying water to the interior wash space 12 of the dish washing machine 10 via the top rotating spray arm 16 and the bottom rotating spray arm 18 as set forth in U.S. Pat. No. 10,905,306 entitled DISH WASHING MACHINE, the entire contents of which are hereby incorporated herein by reference, could be used. Alternatives could also be used. For example, the system could use only one of the top rotating spray arm 16 or the bottom rotating spray arm 18, the arms could be stationary and/or could employ other nozzles (e.g., stationary nozzles extending from interior walls) for spraying water onto the dishes for cleaning the dishes.

In the illustrated embodiment, the system works by first pre-heating the water supplied to the booster heating tank 20. The water is pre-heated using a heat exchange system as outlined below. After heated to a desired temperature in the booster heating tank 20, the water is sucked by a pump from the booster heating tank 20 into a line with a splitter or a pair of lines to bring the water to an upper line 30 that leads to the top rotating spray arm 16 and a lower line 32 that leads to the bottom rotating spray arm 18. The upper line 30 and the lower line 32 can both have a one-way valve on an end thereof to prevent water from returning thereto. The heated water from the upper line 30 and the lower line 32 spray through nozzles in the top rotating spray arm 16 and the bottom rotating spray arm 18, respectively. After leaving the top rotating spray arm 16 and the bottom rotating spray arm 18, the heated water falls to a bottom basin 26 and flows through a bottom hole therein into a wash tank 28.

In the illustrated example, once enough water pools into the wash tank 28, the wash process is ready to begin. A wash detergent can be injected into the wash tank 28 to help with the cleaning of the dishes and the water in the wash tank is heated (e.g., to about 65° C. or higher). When the wash process is ready to begin, the supply of water from the booster heating tank 20 to the wash tank 28 via the spray arms 16, 18 is stopped. It is contemplated that wash detergent could be added to the wash tank 28 periodically or continually during the wash process. After the wash detergent is added to the water in the wash tank 28, a wash pump forces the water in the wash tank 28 into an upper wash line 22 and a lower wash line 24. The upper wash line 22 leads to a wash path in the top rotating spray arm 16 and the lower wash line 24 leads to a wash path in the bottom rotating spray arm 18. The upper wash line 22 and the lower wash line 24 can both have a one-way valve on an end thereof to prevent water from returning thereto. The wash water from the upper wash line 22 and the lower wash line 24 spray through wash nozzles in the top rotating spray arm 16 and the bottom rotating spray arm 18, respectively. The force of the wash water leaving the wash nozzles forces the top rotating spray arm 16 (spraying downward) and the bottom rotating spray arm 18 (spraying upward) to rotate as is well known to those skilled in the art. Eventually, the wash water falls to the bottom basin 26 and flows through the bottom hole therein into the wash tank 28, wherein the process of pumping the wash water to the top rotating spray arm 16 and the bottom rotating spray arm 18 continuously occurs during the washing cycle. After the illustrated washing cycle is complete, the wash water is removed from the dish washing machine 10 through a drain pipe 34 by force of a discharge pump and/or gravity.

In the illustrated example, after the dishes in the dish washing machine 10 have been washed, the dishes are rinsed. During the rinsing cycle, more pre-heated water is supplied to the booster heating tank 20. Once in the booster heating tank 20, the water is heated to assist in rinsing the dishes. It is contemplated that the booster heating tank 20 can heat the water to about 85° C. or higher. It is contemplated that the system for washing dishes could measure the temperature of the water in the booster heating tank 20 before proceeding or the water could be heated in the booster heating tank 20 for a certain period of time before proceeding. During, before or after the water is heated in the booster heating tank 20, a rinse aid is injected into the booster heating tank 20 to help with the rinsing of the dishes. After the rinse water is heated and the rinse aid is added thereto, the rinse pump sucks the rinse water from the booster heating tank 20 and cycles the rinse water several times through the system in the same manner as the wash water passing through the system. Even though the pumping of the wash water and the rinse water from the wash tank 28 is described as happening in two steps (i.e., the washer water and then the rinse water is pumped from the wash tank 28), it is contemplated that the rinsing of the dishes can take place directly after the washing cycle such that a mixture of the wash water and the rinse water is pumped from the wash tank 28 to the outlet. Furthermore, it is contemplated that not all wash water and rinse water are drained away from the wash tank 28 after each wash cycle.

Aspects of the present embodiment include a method of pre-heating water from a source of water before the water enters the booster heating tank 20. FIGS. 1-6 illustrate a system with a first heat exchange system 36 and a second heat exchange system 38, although it is contemplated that only one of the first heat exchange system 36 or the second heat exchange system 38 could be used. Moreover, while the water is shown as being pre-heated by traveling from the first heat exchange system 36 to the second heat exchange system 38, the path could be reversed with the water traveling first to the second heat exchange system 38 and then to the first heat exchange system 36.

Figure 3:
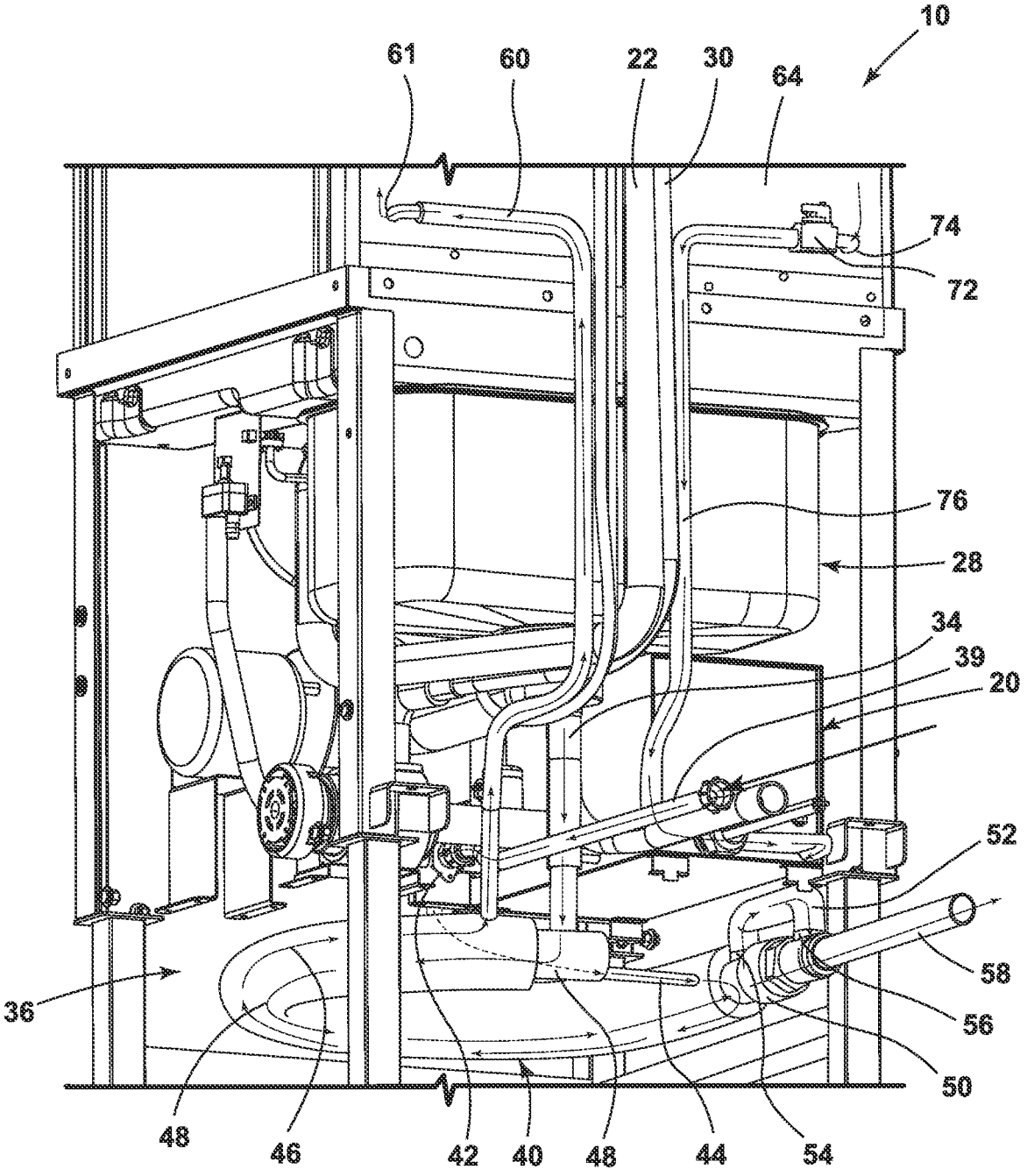
FIG. 3 is a close-up partial rear perspective view of the dish washing machine according to an embodiment illustrating flow of heat exchanged fluid.
Figure 4:
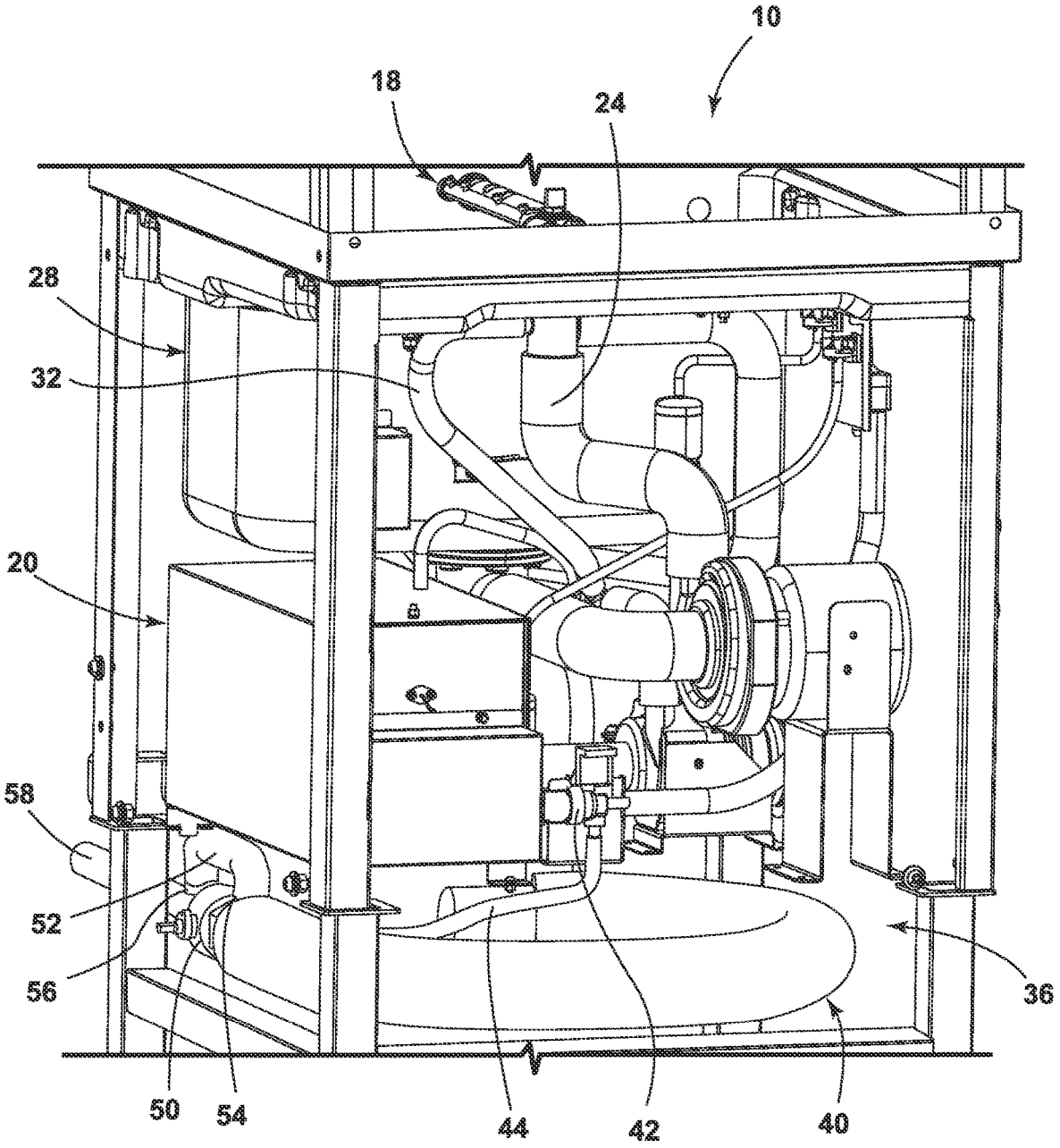
FIG. 4 is a close-up partial front perspective view of the dish washing machine according to an embodiment illustrating flow of heat exchanged fluid.

In the illustrated example, the first heat exchange system 36 uses waste water from the wash tank 28 to heat the water entering the booster heating tank 20. As illustrated in FIG. 3, water enters the dish washing machine 10 through an inlet pipe 39. The inlet pipe 39 ends at an input valve 42 that is selectively actuated to allow water to enter the dish washing machine 10. Once the input valve 42 is opened, water passes through an entrance pipe 44 into the first heat exchange system 36. The first heat exchange system 36 includes a heat exchange pipe 40 that has the water from the entrance pipe 44 flowing therethrough.

In the illustrated embodiment, hot waste water also flows through the heat exchange pipe 40 to transfer heat from the hot waste water to the input water. In the illustrated example, the heat exchange pipe 40 includes an outer tube 46 having the water from the entrance pipe 44 flow therethrough. The outer tube 46 surrounds a hot water exit tube 48 that has hot waste water flowing in a direction opposite to the outer tube 46. As outlined above, after the washing cycle and the rinsing cycle, the drain pipe 34, which is connected to the wash tank 28, selectively allows the hot waste water to empty from the wash tank 28. The drain pipe 34 is connected to the hot water exit tube 48 such that the hot waste water transfers heat to the input water as the waste water and rinse water pass through the hot water exit tube 48. While a co-axial design of the heat exchange pipe 40 is illustrated, it is contemplated that any boundary wall could be used in the heat exchange pipe 40 and the input water and the hot waste water could exchange heat in any manner in the heat exchange pipe 40. Moreover, the heat exchange pipe 40 could have any cross-sectional shape (e.g., circular, U-shaped, rectangular or any other shape) and the length of the heat exchange pipe 40 could be any length (and that preferably resides within the same footprint as the housing of the dish washing machine 10).

The illustrated first heat exchange system 36 can allow the input water and/or the waste water to be held within the heat exchange pipe 40 or selectively flow through the heat exchange pipe 40. A flow control device 50 is located at an end of the heat exchange pipe 40 to control flow of the waste water through the heat exchange pipe 40. The flow control device 50 can hold the waste water within the heat exchange pipe 40 or let the waste water pass through one or multiple internal sections of the heat exchange pipe 40.

In the illustrated example, a bypass pipe 52 can be located adjacent the flow control device 50 and have an input side 54 before the flow control device 50 and an output side 56 after the flow control device 50. The bypass pipe 52 is located above the flow control device 50 to allow excess waste water to flow through the bypass pipe 52 to an exit tube 58 that allows the waste water to exit the dish washing machine 10. Waste water can only enter and pass through the bypass pipe 52 when pressure from the water entering the heat exchange pipe 40 is strong enough to overcome the force of gravity to rise up through the input side 54 of the bypass pipe 52. However, since the heat exchange pipe 40 is on the same level as the flow control device 50, the flow control device 50 can close to keep waste water within the heat exchange pipe 40. In one embodiment, gravity can push the waste water up through the input side 54 of the bypass pipe 52 because the wash tank 28 is higher than the bypass pipe 52. The system will level out when the waste water in the drain pipe 34 is at the same level as the bypass pipe 52. At that point, the system will be at equilibrium with waste water still in the heat exchange pipe 40. At the equilibrium state, the waste water will only drain from the heat exchange pipe 40 when the flow control device 50 opens to allow the waste water to exit to the exit tube 58. The bypass pipe 52 allows for subsequent waste water to flow past the flow control device 50 while a portion of the hot waste water is held inside the heat exchange pipe 40. The flow control device 50 (and gravity) can be used to hold the hot waste water within the heat exchange pipe 40 to therefore allow the hot waste water longer contact time with the input water for greater heat exchange. The flow control device 50 can be opened to drain away all waste water in the heat exchange pipe 40 at the end of a day.

In the illustrated example, the input water can also pass through the second heat exchange system 38 to increase the temperature of the input water before the water enters the booster heating tank 20. As shown in FIG. 3, a first transfer pipe 60 extends between the first heat exchange system 36 and the second heat exchange system 38. The first transfer pipe 60 takes the water from the outer tube 46 of the heat exchange pipe 40 to an entrance 61 of the second heat exchange system 38. The first transfer pipe 60 extends in at least a portion adjacent a rear side of the housing of the dish washing machine 10.

The illustrated second heat exchange system 38 includes at least one wall 62 adjacent the interior wash space 12 of the dish washing machine 10 that has the water from the first transfer pipe 60 passing therethrough. In the illustrated embodiment, the at least one wall 62 comprising the second heat exchange system 38 includes a rear wall 64 and a top wall 66. Each of the rear wall 64 and the top wall 66 include a plurality of cells or compartments 68 for holding water. As the wash water or rinse water is spraying within the interior wash space 12 of the dish washing machine 10 from the top rotating spray arm 16 and the bottom rotating spray arm 18, the hot wash water or rinse water will spray against or splash against an interior side 70 of the rear wall 64 and the top wall 66, thereby heating the interior side 70 of the rear wall 64 and the top wall 66. The hot interior side 70 of the rear wall 64 and the top wall 66 will then heat the water within the cells or compartments 68 of the rear wall 64 and the top wall 66. Moreover, hot air and/or mist inside the interior wash space 12 of the dish washing machine 10 will also transfer heat to the interior side 70 of the rear wall 64 and the top wall 66 and thereby the water within the cells or compartments 68 of the rear wall 64 and the top wall 66. It is contemplated that the at least one wall 62 can be made from one or multiple sheets of metal formed and/or welded together to form the cells or compartments 68 and a boundary wall of the at least one wall 62 to keep the water within the at least one wall 62. The second heat exchange system 38 can be an integral part of the dish washing machine 10 or can be attached (permanently or removably) to the inside of the dish washing machine 10. The second heat exchange system 38 also helps to reduce the exterior temperature of the dish washing machine as the walls 62 of the dish washing machine have a reduced temperature because of the transfer of the heat to the water therein.

Figure 2:
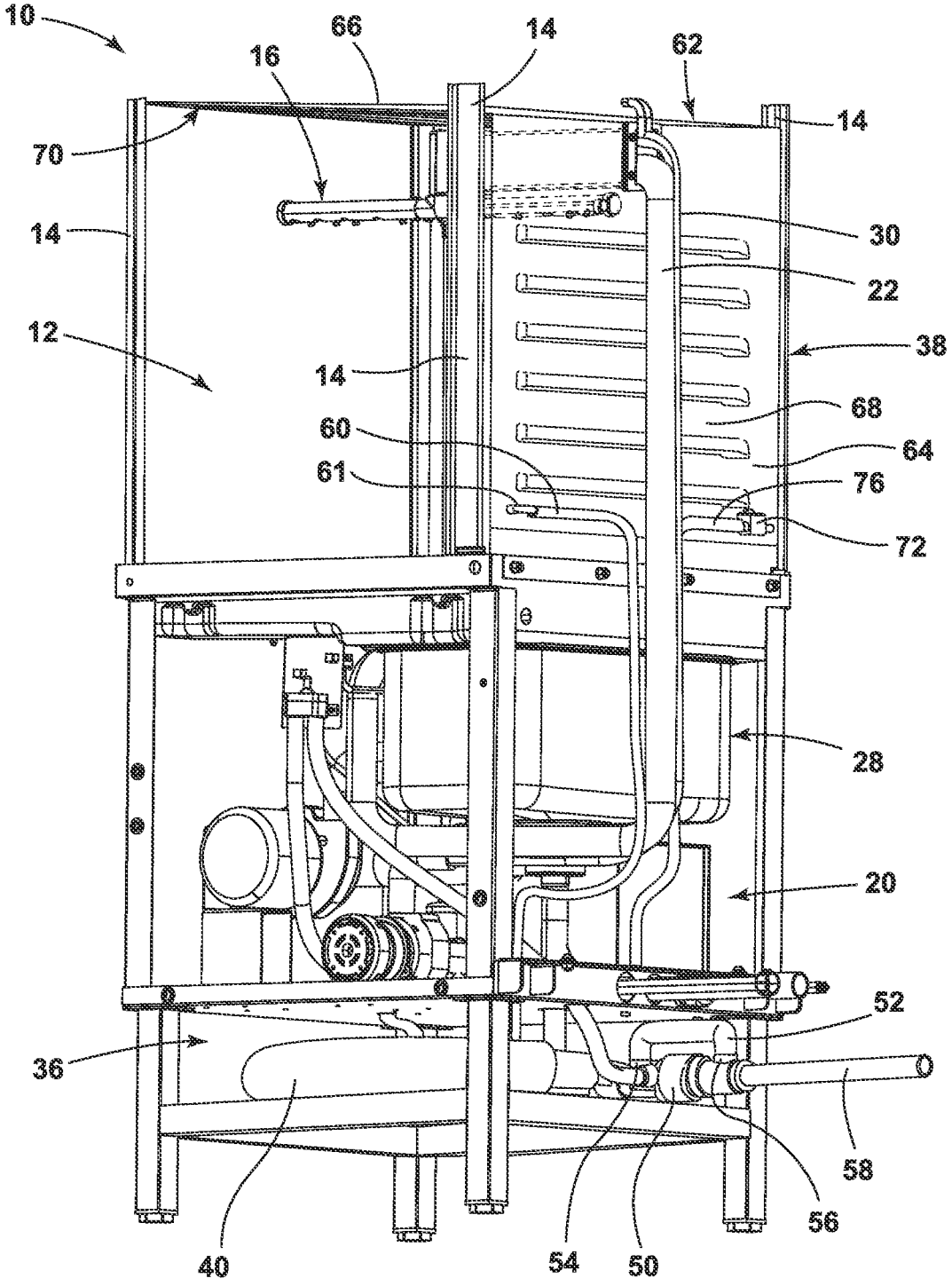
FIG. 2 is a rear perspective view of the dish washing machine according to an embodiment with walls and a door removed for reference.
Figure 5:
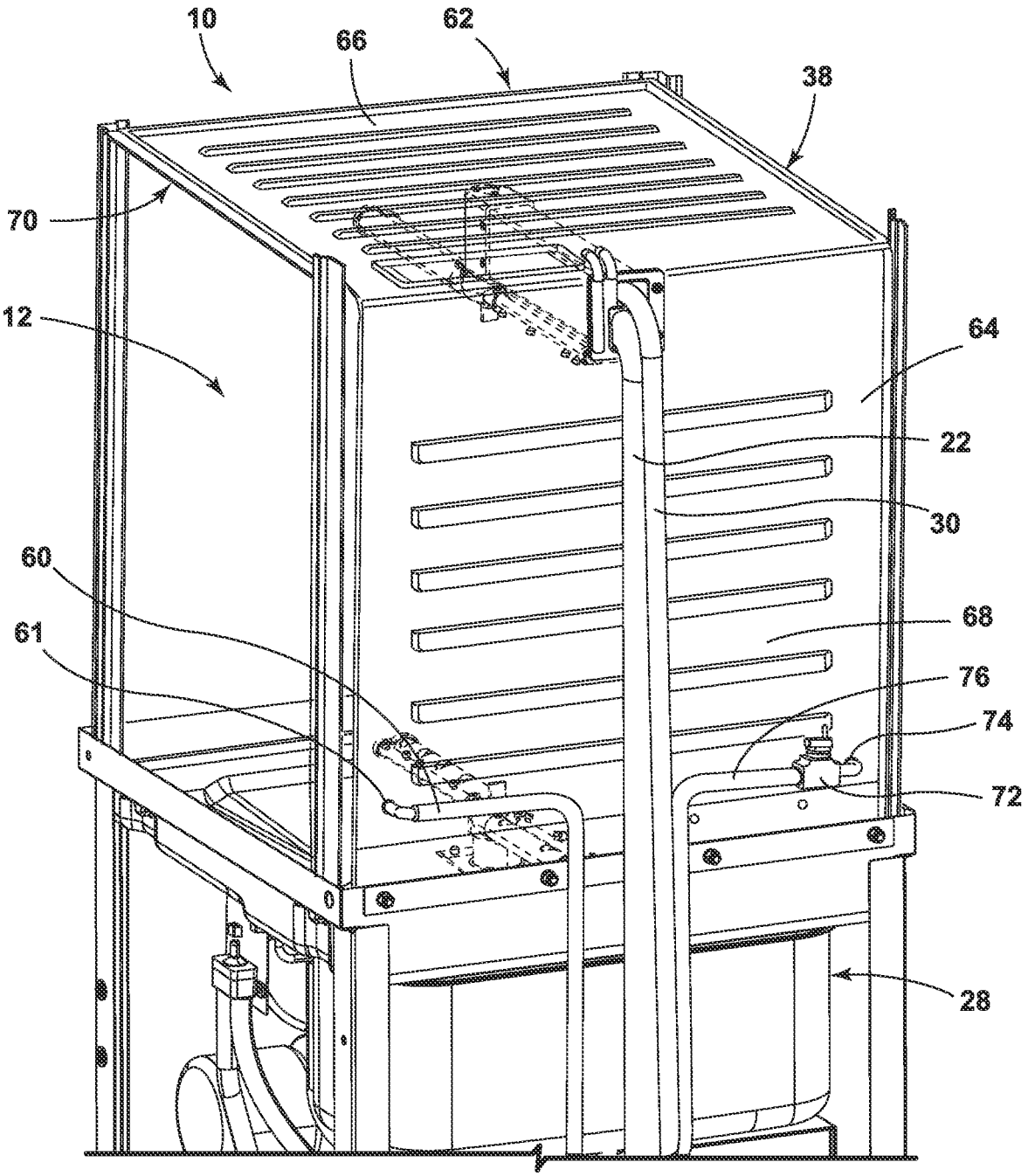
FIG. 5 is a partial rear perspective view of the dish washing machine according to an embodiment illustrating a second heat exchanger.
Figure 6:
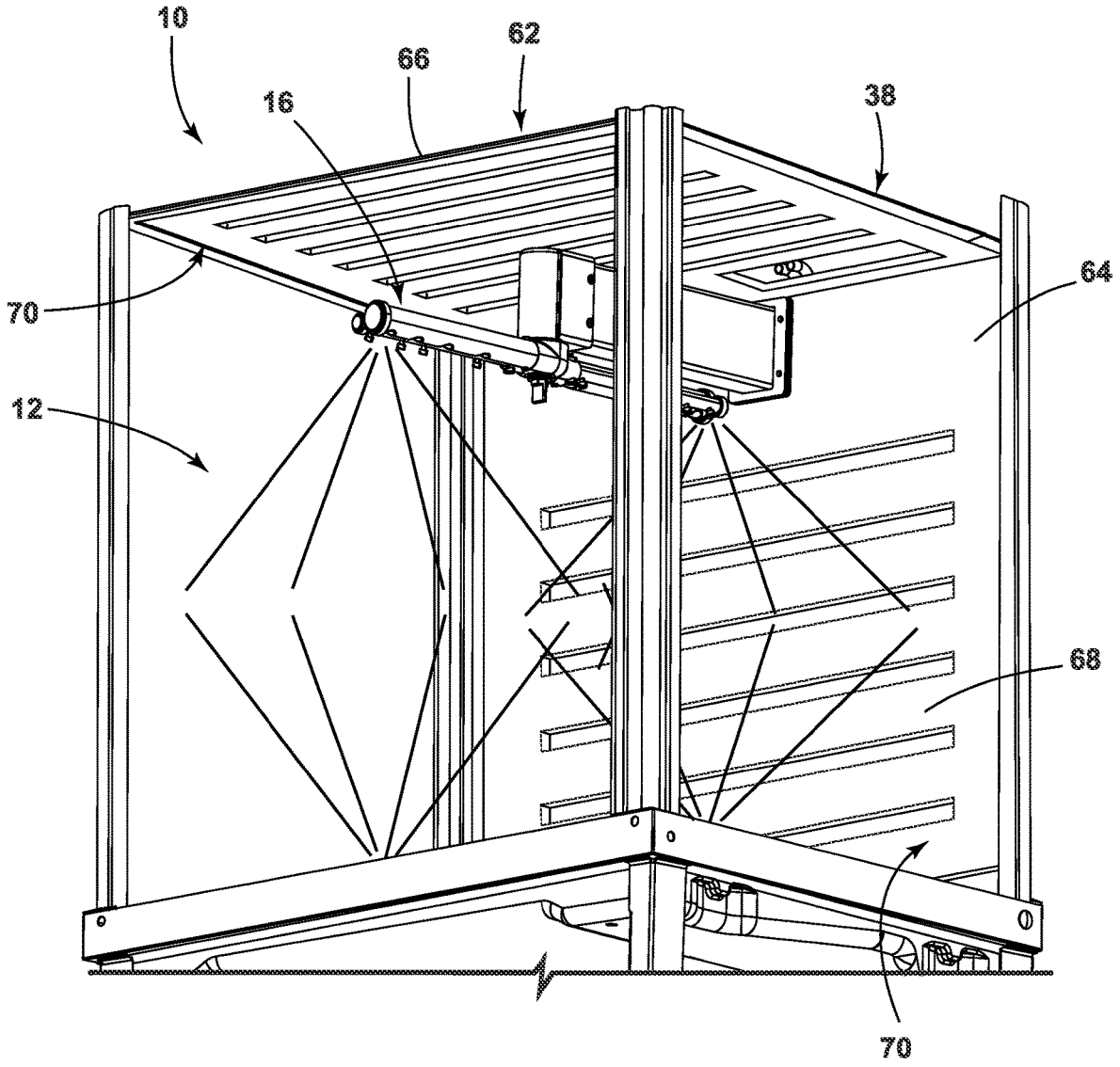
FIG. 6 is a partial front perspective view of the dish washing machine according to an embodiment illustrating fluid spray and a heat exchanger.

It is contemplated that the water can be circulated and/or retained temporarily within the cells or compartments 68 to heat the water therein. As shown in FIGS. 2 and 5, an outlet valve 72 can be located at an outlet 74 of the second heat exchange system 38 to retain the water within the second heat exchange system 38 for a desired period. After the heated water exits the second heat exchange system 38 through the outlet 74, the heated water passes through a second transfer pipe 76 to the booster heating tank 20.

Figure 7:
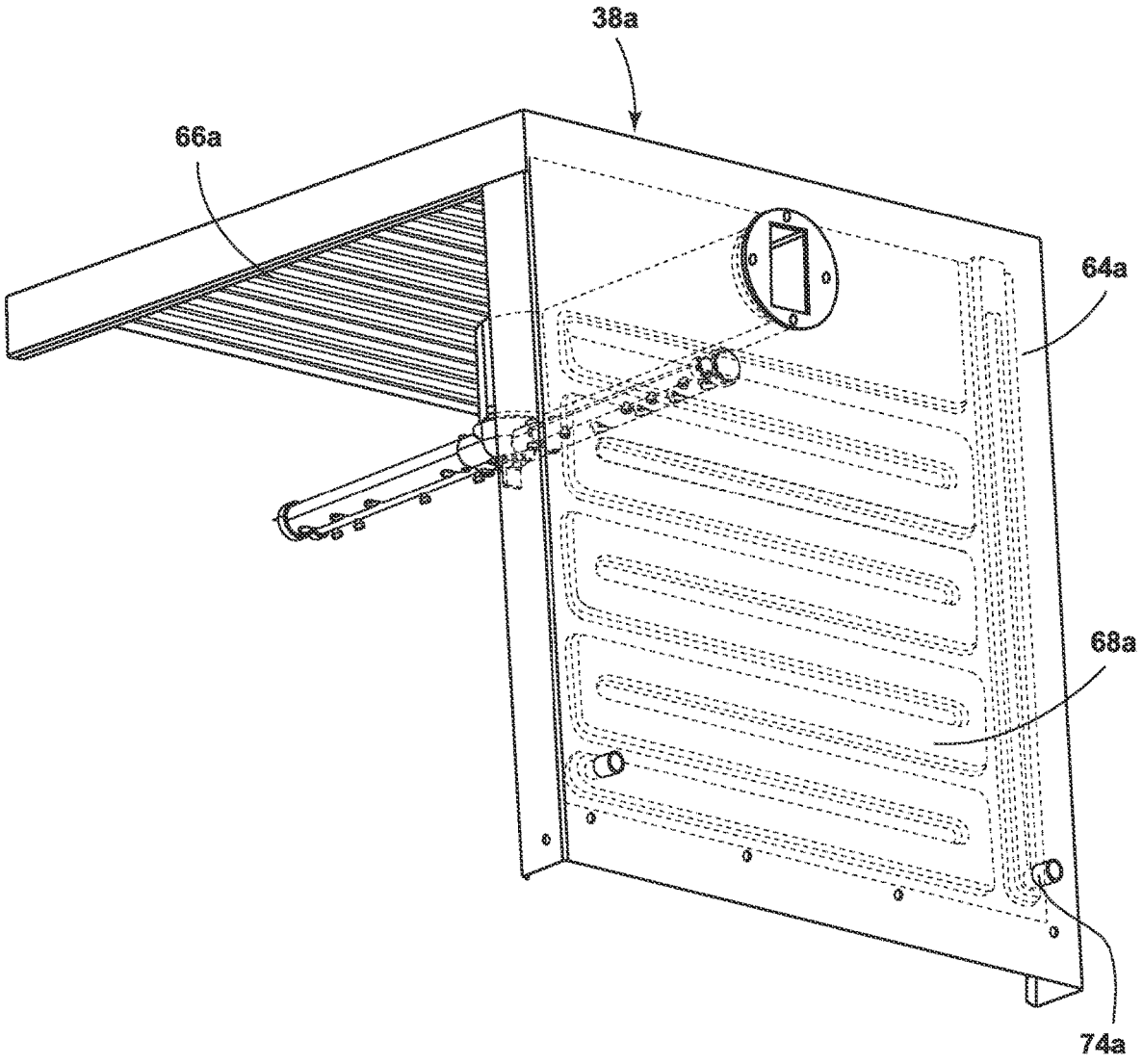
FIG. 7 is a rear perspective view of a second heat exchanger of the dish washing machine according to another embodiment.
Figure 8:
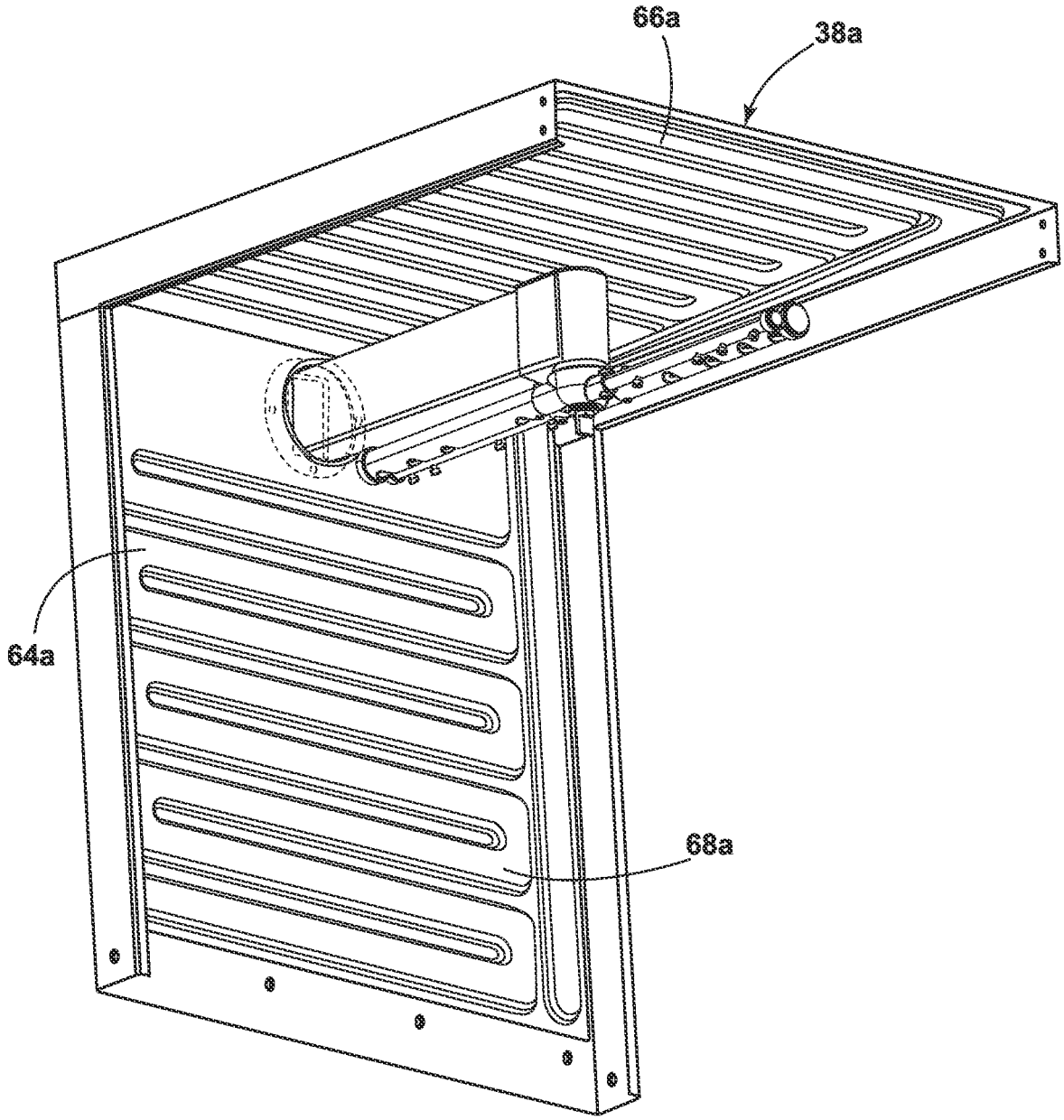
FIG. 8 is a first front perspective view of a second heat exchanger of the dish washing machine according to another embodiment.
Figure 9:
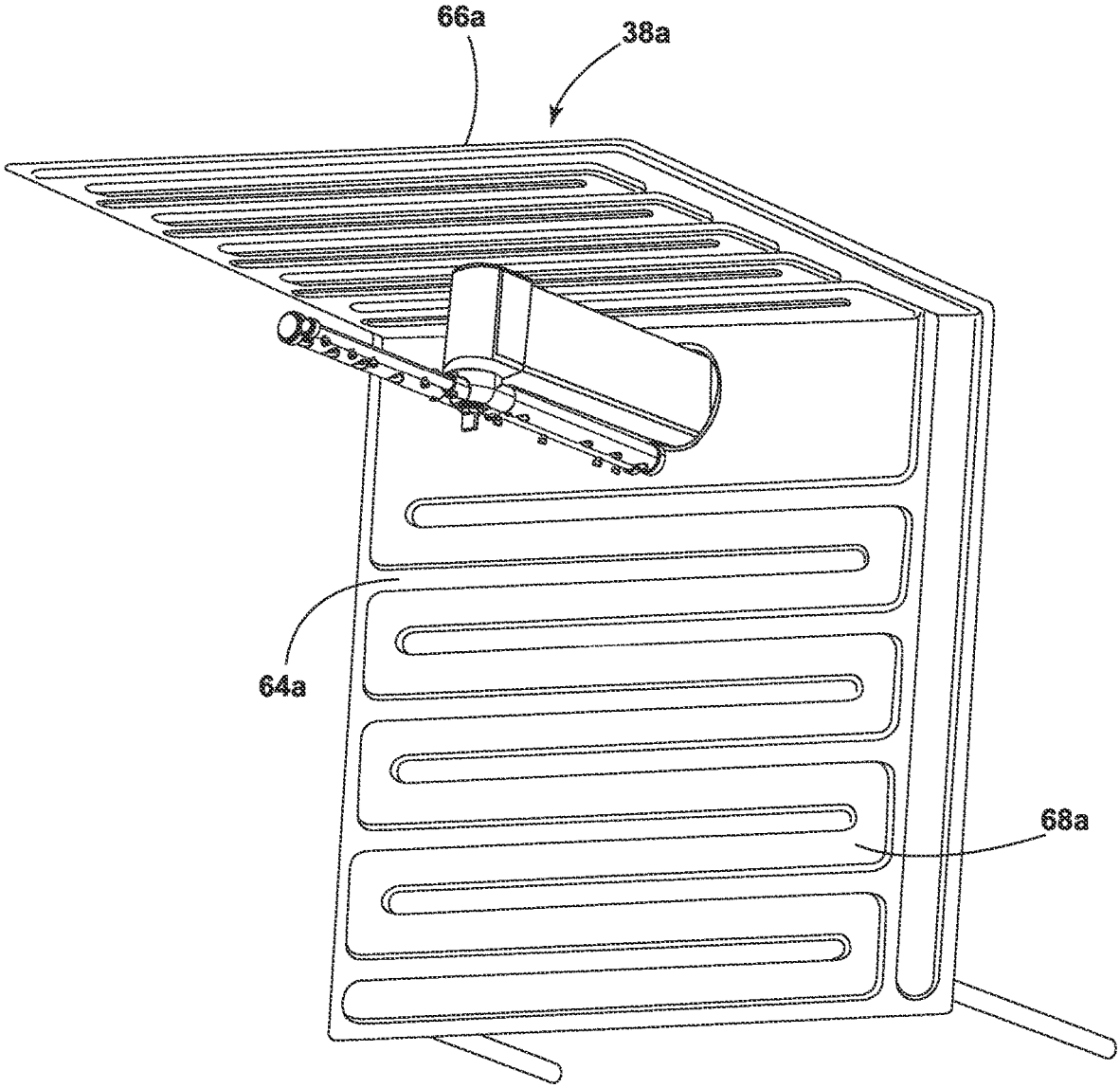
FIG. 9 is a second front perspective view of a second heat exchanger of the dish washing machine according to another embodiment.
Figure 10:
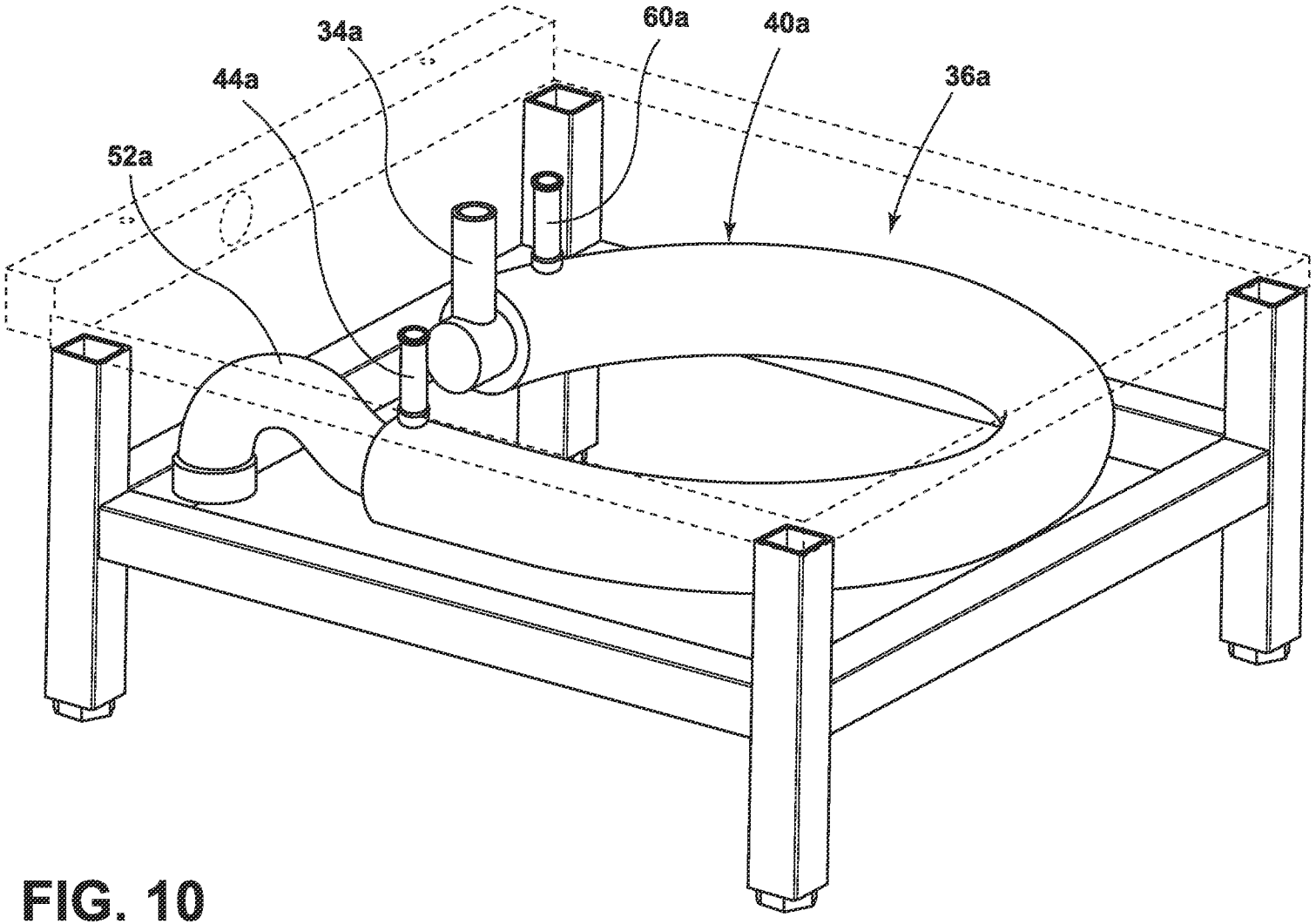
FIG. 10 is a first perspective view of a first heat exchanger of the dish washing machine according to another embodiment.
Figure 11:
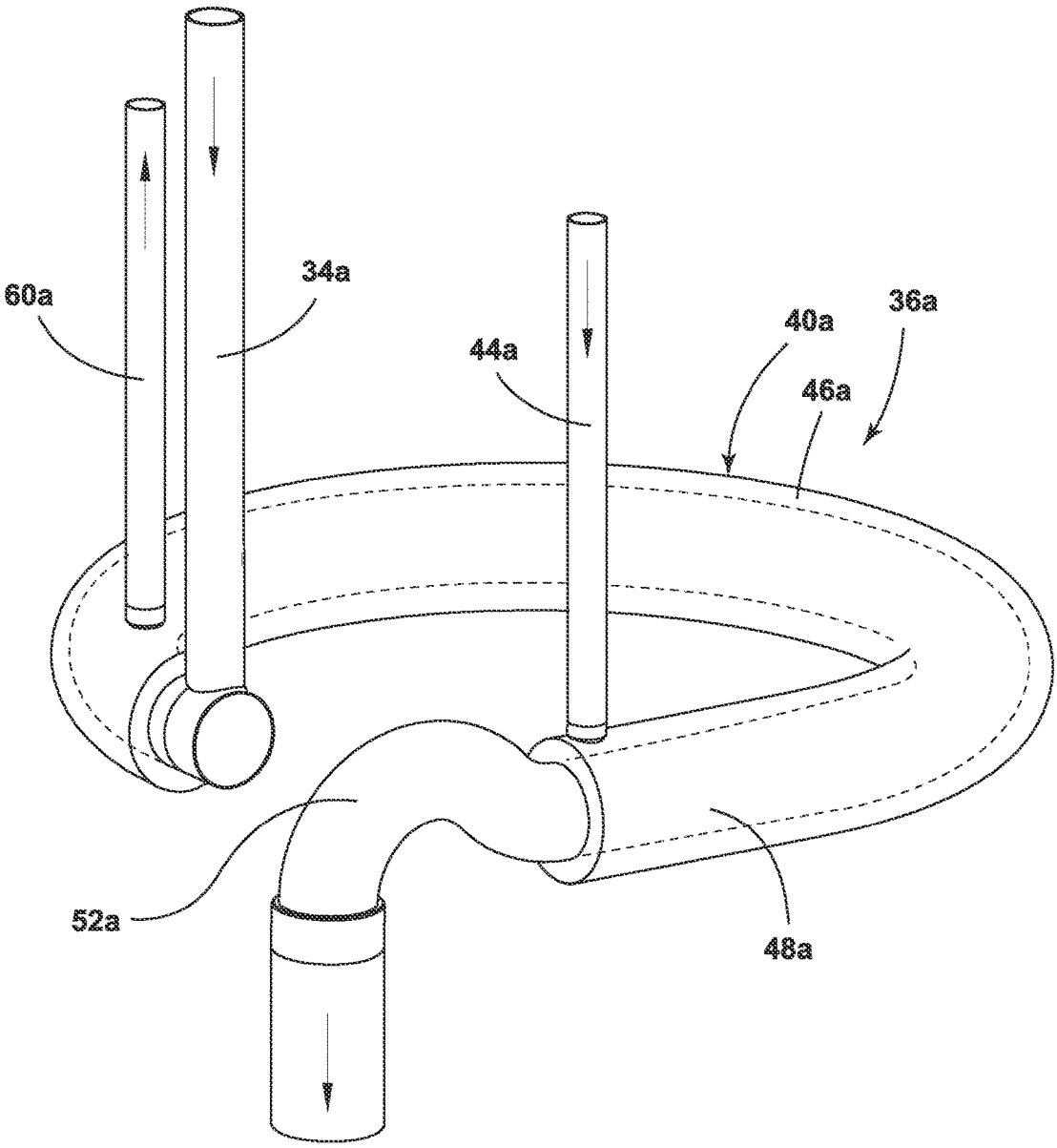
FIG. 11 is a second perspective view of the first heat exchanger of the dish washing machine according to the another embodiment.
Figure 12:
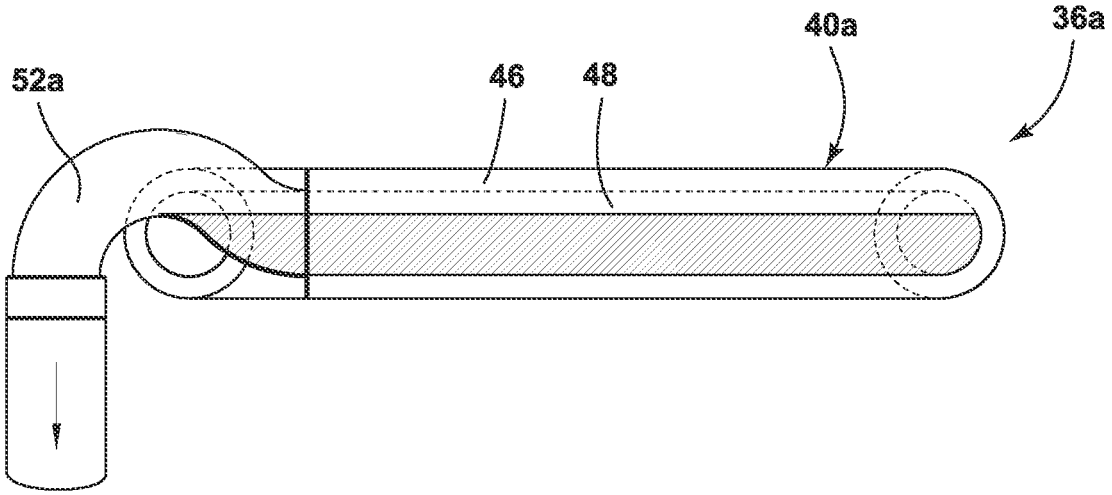
FIG. 12 is a side view of the first heat exchanger of the dish washing machine according to the another embodiment.
Figure 13:
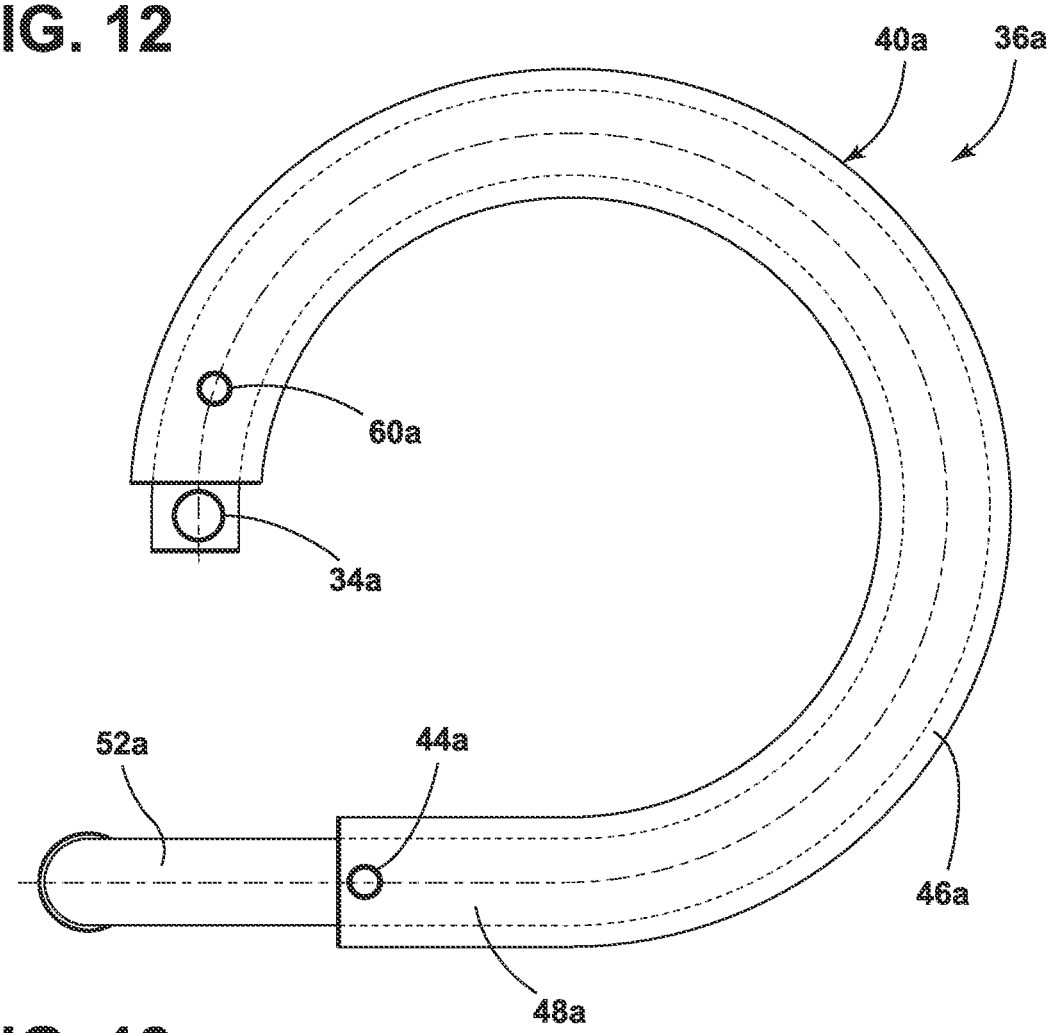
FIG. 13 is a top view of the first heat exchanger of the dish washing machine according to the another embodiment.
Figure 14:
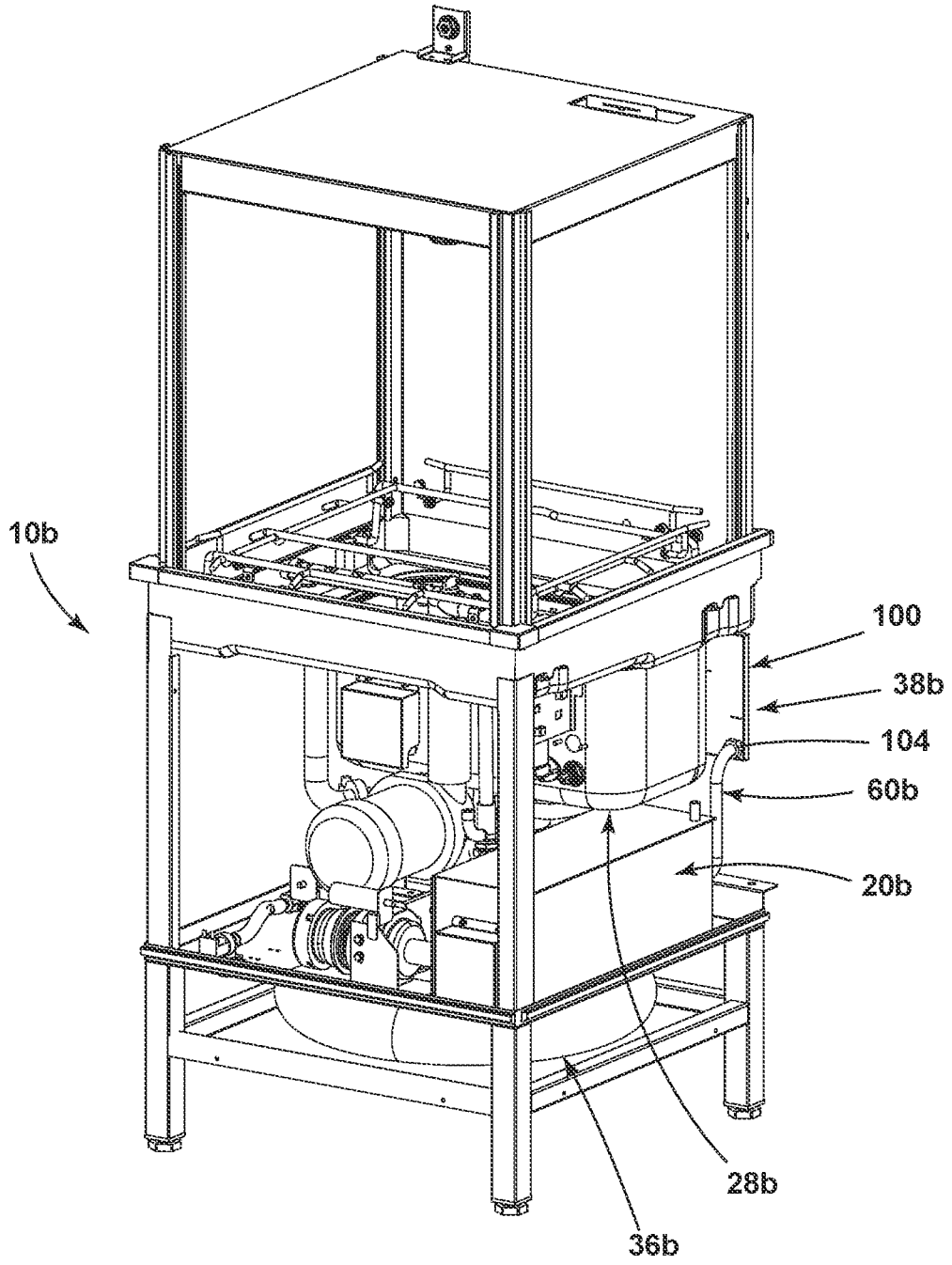
FIG. 14 is a front perspective view of a second embodiment of a dish washing machine according to an embodiment with walls and a door removed for reference.
Figure 15:
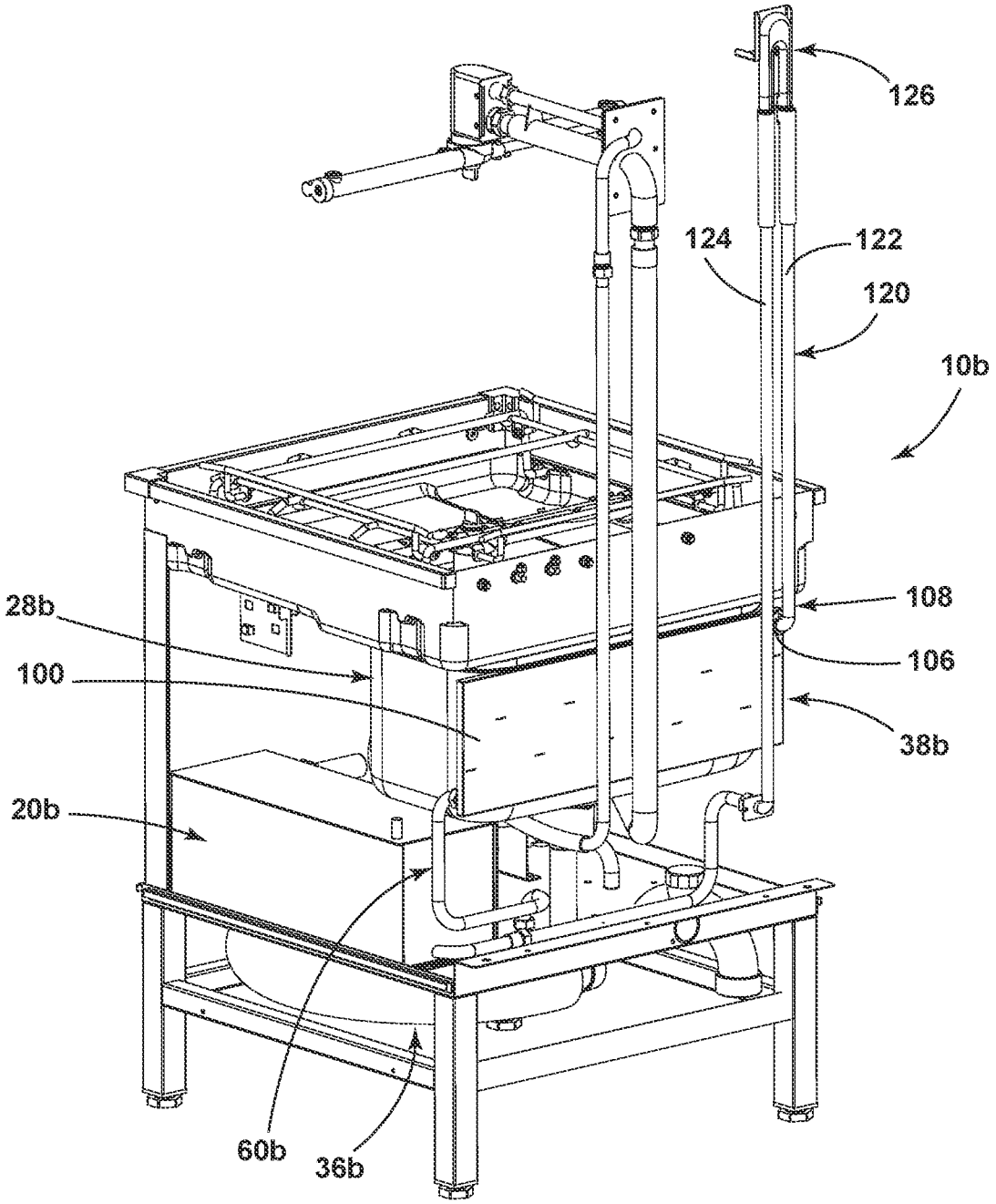
FIG. 15 is a rear perspective view of the second embodiment of the dish washing machine according to an embodiment with walls and a door removed for reference.

The reference numeral 38*a* (FIGS. 7-9) generally designates another embodiment of the present invention, having a second embodiment for the second heat exchange system. Since the second embodiment of the second heat exchange system 38*a* is similar to the previously described second heat exchange system 38, similar parts appearing in FIGS. 1-6 and FIGS. 7-9, respectively, are represented by the same, corresponding reference number, except for the suffix "a" in the numerals of the latter. The second embodiment of the second heat exchange system 38*a* includes the cells or compartments 68*a* that have a serpentine path through both the rear wall 64*a* and the top wall 66*a*, thereby making a single path through the second heat exchange system 38*a*. The second embodiment of the second heat exchange system 38*a* may or may not have the valve at the outlet 74*a* to allow the water to pass through the second heat exchange system 38*a* without being retained with the second heat exchange system 38*a*.

The reference numeral 36*a* (FIGS. 10-13) generally designates another embodiment of the present invention, having a second embodiment for the first heat exchange system. Since the second embodiment of the first heat exchange system 36*a* is similar to the previously described first heat exchange system 36, similar parts appearing in FIGS. 1-6 and FIGS. 10-13, respectively, are represented by the same, corresponding reference number, except for the suffix "a" in the numerals of the latter. The second embodiment of the first heat exchange system 36*a* does not include the flow control device 50 and the bypass pipe 52*a* maintains water within the heat exchange pipe 40*a* as outlined above.

The dish washing machine 10 includes heat exchangers that allow the heat from the waste water to preheat the water entering the system, thereby saving energy and also releasing cooler water to the environment than would happen without the heat exchanger. It is contemplated that the system might not have a booster heating tank and that the water heated in the first and/or second could first be sprayed though the sprayers and then heated in the wash tank before washing and subsequent rinsing.

The reference numeral 10*b* (FIGS. 14-17) generally designates another embodiment of the present invention, having a second embodiment for the dish washing machine. Since the second embodiment of the dish washing machine is similar to the previously described dish washing machine 10, similar parts appearing in FIGS. 1-13 and FIGS. 14-17, respectively, are represented by the same, corresponding reference number, except for the suffix "b" in the numerals of the latter.

In the illustrated embodiment, the second embodiment of the dish washing machine 10*b* includes a first heat exchange system 36*b* and a second heat exchange system 38*b*. The first heat exchange system 36*b* can be either the first embodiment of the first heat exchange system 36 as outlined above in association with FIGS. 1-4, 10 and 11 or the second embodiment of the first heat exchange system 36*a* as outlined above in association with FIGS. 12 and 13. In the second embodiment of the dish washing machine 10*b*, water enters the first heat exchange system 36*b* through the entrance pipe 44*b*, passes through the first heat exchange system 36*b* to exchange heat with the water coming from the drain pipe 34*b*, and then passes to the second heat exchange system 38*b* through a first transfer pipe 60*b*.

Figure 16:
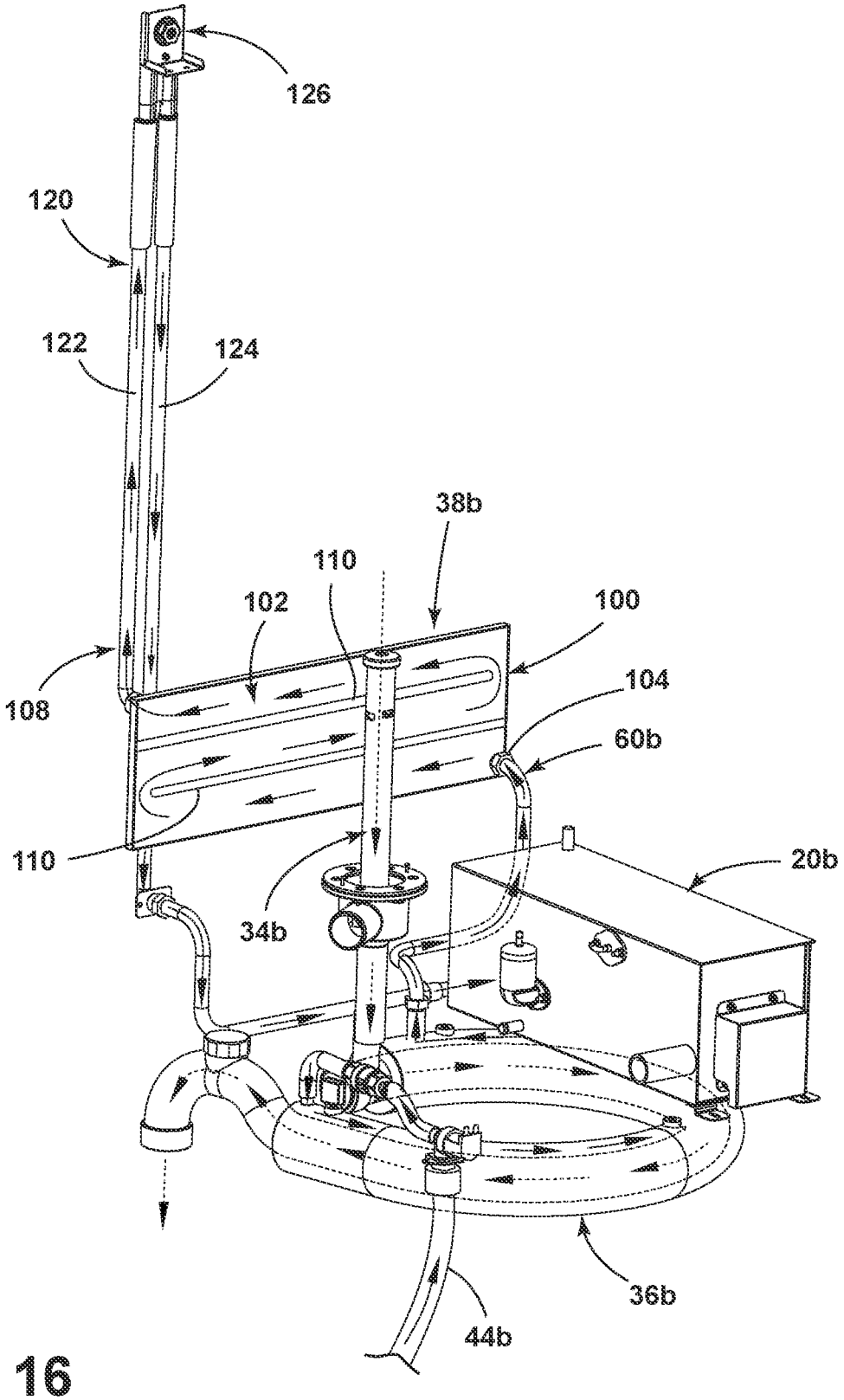
FIG. 16 is a front perspective view of heat exchange systems of the second embodiment of the dish washing machine.
Figure 17:
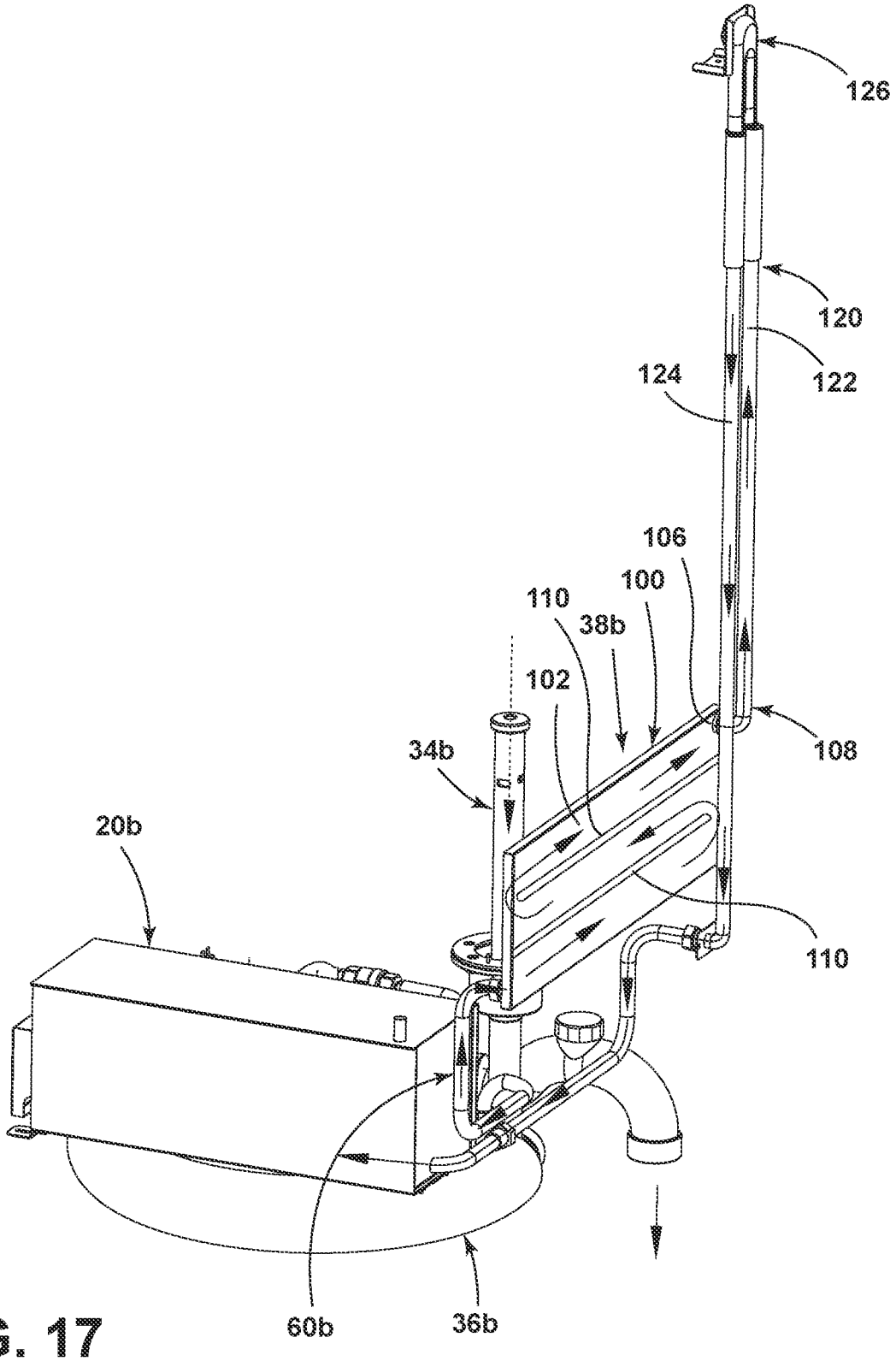
FIG. 17 is a front perspective view of heat exchange systems of the second embodiment of the dish washing machine.

The illustrated second heat exchange system 38*b* is employed to even further heat the water coming from the first heat exchange system 36*b*. The second heat exchange system 38*b* includes a wall panel 100 having an internal path 102 therefore for movement of the water therethrough from an entrance 104 where the first transfer pipe 60*b* engages the wall panel 100 to an exit 106 where the water exits the second heat exchange system 38*b* to enter a second transfer pipe system 108. The internal path 102 within the wall panel 100 can include a plurality of dividers 110 to force the water passing through the wall panel 100 to have several changes of direction as shown by the arrows in FIGS. 16 and 17. While two dividers 110 are shown in FIGS. 16-17, it is contemplated that any number of dividers 110 or no dividers 110 can be used in the internal path 102 of the second heat exchange system 38*b*.

In the illustrated example, heat from water in the wash tank 28*b* and/or from a heat system of the wash tank 28*b* is transferred to the water in the wall panel 100 of the second heat exchange system 38*b*. The wash tank 28*b* is configured to hold heated water therein during a wash cycle of the dish washing machine 10*b*. The wash tank 28*b* either has a wall separating an interior thereof holding the heated water that forms a wall of the wall panel 100 (i.e., a single separating wall) or the wall of the wash tank 28*b* is in contact with a wall of the wall panel 100 (i.e., multiple walls in contact with each other). Therefore, the heat from the heated water in the wash tank 28*b* is transferred to the water passing through the wall panel 100 of the second heat exchange system 38*b*. It is also contemplated that any heating coils or similar elements that are employed to directly heat the water in the wash tank 28*b* could also be employed to directly heat the water in the wall panel 100 of the second heat exchange system 38*b*. In addition to the wall adjacent the heated water in the wash tank 28*b*, the dividers 110 and further elements extending into the internal path 102 can be employed to increase the heat transfer to the water within the wall panel 100.

Once the water exits the illustrated second heat exchange system 38*b* through the exit 106, the water passes to the booster heating tank 20*b* through the second transfer pipe system 108. The second transfer pipe system 108 can include a single pipe that passes directly to the booster heating tank 20*b*. It is also contemplated that the second transfer pipe system 108 can be an air gap system 120 that includes an up pipe 122, a down pipe 124 and an inverted U-Shaped connecter 126 that connects top ends of the up pipe 122 and the down pipe 124. As is well known to those skilled in the art, the air gap system 120 prevents contaminated water from reentering the second heat exchange system 38*b* via backflow. The air gap system 120 is a simple way to make certain wastewater and contaminants do not reenter the clean water supply. When the air gap system 120 is employed, the water passes through the exit 106 of the second heat exchange system 38*b* directly to the up pipe 122 and then passes to the down pipe 124 via the inverted U-Shaped connecter 126. The down pipe 124 is directly connected to the booster heating tank 20*b*.

The first heat exchange system 36*b* and the second heat exchange system 38*b* efficiently heat the water entering the second embodiment of dish washing machine 10*b* before the water is heated in the booster heating tank 20*b*. It is contemplated that the second embodiment of dish washing machine 10*b* could additionally include the second heat exchange system 38 as described in association with FIGS. 1-9 such that the second embodiment of dish washing machine 10*b* includes at least three total heat exchange systems. Moreover, it is contemplated that the second embodiment of dish washing machine 10*b* could additionally include only the second heat exchange system 38*b* and not the first heat exchange system 36*b*.

The reference numeral 10*c* (FIG. 18) generally designates another embodiment of the present invention, having a third embodiment for the dish washing machine. Since the third embodiment of the dish washing machine is similar to the previously described second embodiment of the dish washing machine 10*b*, similar parts appearing in FIGS. 14-17 and FIG. 18, respectively, are represented by the same, corresponding reference number, except for the suffix "c" in the numerals of the latter.

In the third embodiment for the dish washing machine 10*c*, the second heat exchange system 38*c* continues to heat water passing therethrough via heated water in the wash tank 28*c*. The second heat exchange system 38*c* includes a single tube 200 in a circuitous or winding path that is connected to an exterior wall 210 of the wash tank 28*c* by a plurality of connectors 202. The connectors 202 can be any element that holds the single tube 200 against the wash tank 28*c* or even a single connector or a heat transferring adhesive. In the illustrated example, each connector 202 includes a C-shaped portion 204 that surrounds and holds the single tube 200 against the wash tank 28*c* and a pair of flat wings 206 connected to the exterior wall 210 of the wash tank 28*c* (via fasteners or adhesives). It is contemplated that the single tube 200 can include a flat side that rests against the exterior wall 210 of the wash tank 28*c* to maximize the heat transfer surfaces. It is also contemplated that the single tube 200 can contact more than a single exterior wall 210 of the wash tank 28*c* (e.g., two side walls or a side wall and a bottom wall).

Figure 18:
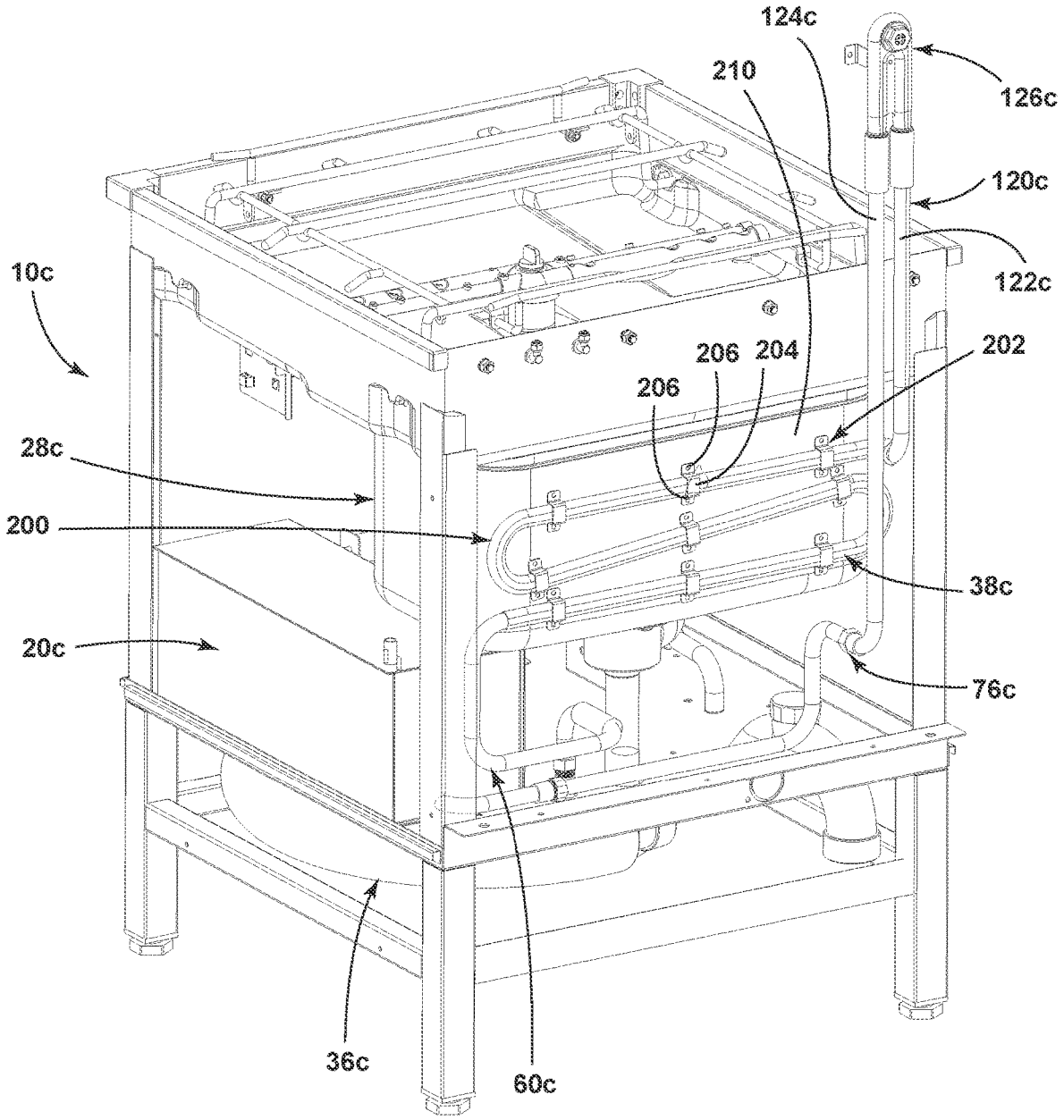
FIG. 18 is a rear perspective view of a third embodiment of the dish washing machine according to an embodiment with walls and a door removed for reference.

In the illustrated example, the water enters the second heat exchange system 38*c* through a first transfer pipe 60*c*, passes through the second heat exchange system 38*c*, and is then transferred directly to the booster heating tank 20*c* via a second transfer pipe 76*c*. It is contemplated that the third embodiment for the dish washing machine 10*c* could include an air gap system between the second heat exchange system 38*c* and the booster heating tank 20*c* or can include the air gap system 120*c* that includes an up pipe 122*c*, a down pipe 124*c* and an inverted U-Shaped connecter 126*c* that connects top ends of the up pipe 122*c* and the down pipe 124*c* as illustrated in FIG. 18. It is contemplated that the third embodiment of dish washing machine 10*c* could additionally include the second heat exchange system 38 as described in association with FIGS. 1-9 such that the third embodiment of dish washing machine 10*c* includes at least three total heat exchange systems. Moreover, it is contemplated that the third embodiment of dish washing machine 10*c* could additionally include only the second heat exchange system 38*c* and not the first heat exchange system 36*c*.

The reference numeral 10*d* (FIGS. 19-20) generally designates another embodiment of the present invention, having a fourth embodiment for the dish washing machine. Since the fourth embodiment of the dish washing machine is similar to the previously described second embodiment of the dish washing machine 10*b*, similar parts appearing in FIGS. 14-17 and FIGS. 19-20, respectively, are represented by the same, corresponding reference number, except for the suffix "d" in the numerals of the latter.

In the fourth embodiment for the dish washing machine 10*d*, a second heat exchange system 38*d* continues to receive heated water from the first heat exchange system 36*d* as outlined above. The second heat exchange system 38*d* of the fourth embodiment includes a heat exchanging panel 302 connected to a rear wall 304 located at a back of the interior wash space 12*d* of the fourth embodiment for the dish washing machine 10*d*. The heat exchanging panel 302 includes a pair of separating paths including a first path 306 and a second path 308 separated by a dividing wall 300. The heat exchanging panel 302 of the second heat exchange system 38*d* receives heated water from the first heat exchange system 36*d* via a first transfer pipe 60*d* and into the first path 306. Heat from within the interior wash space 12*d* is passed to and through the rear wall 304 and the heat exchanging panel 302 to heat the water passing through the first path 306.

Figure 19:
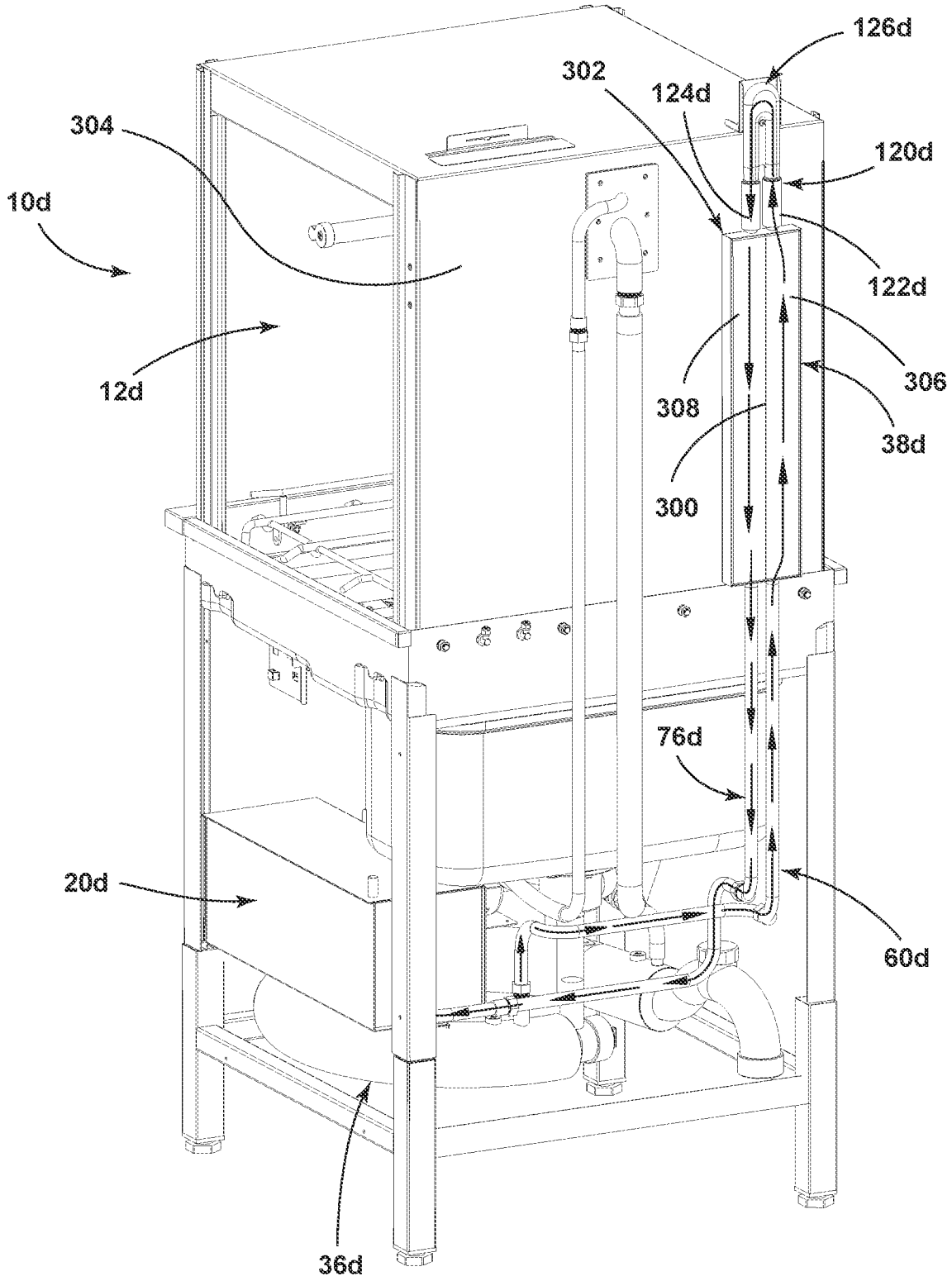
FIG. 19 is a first rear perspective view of a fourth embodiment of the dish washing machine according to an embodiment with some walls and a door removed for reference.
Figure 20:
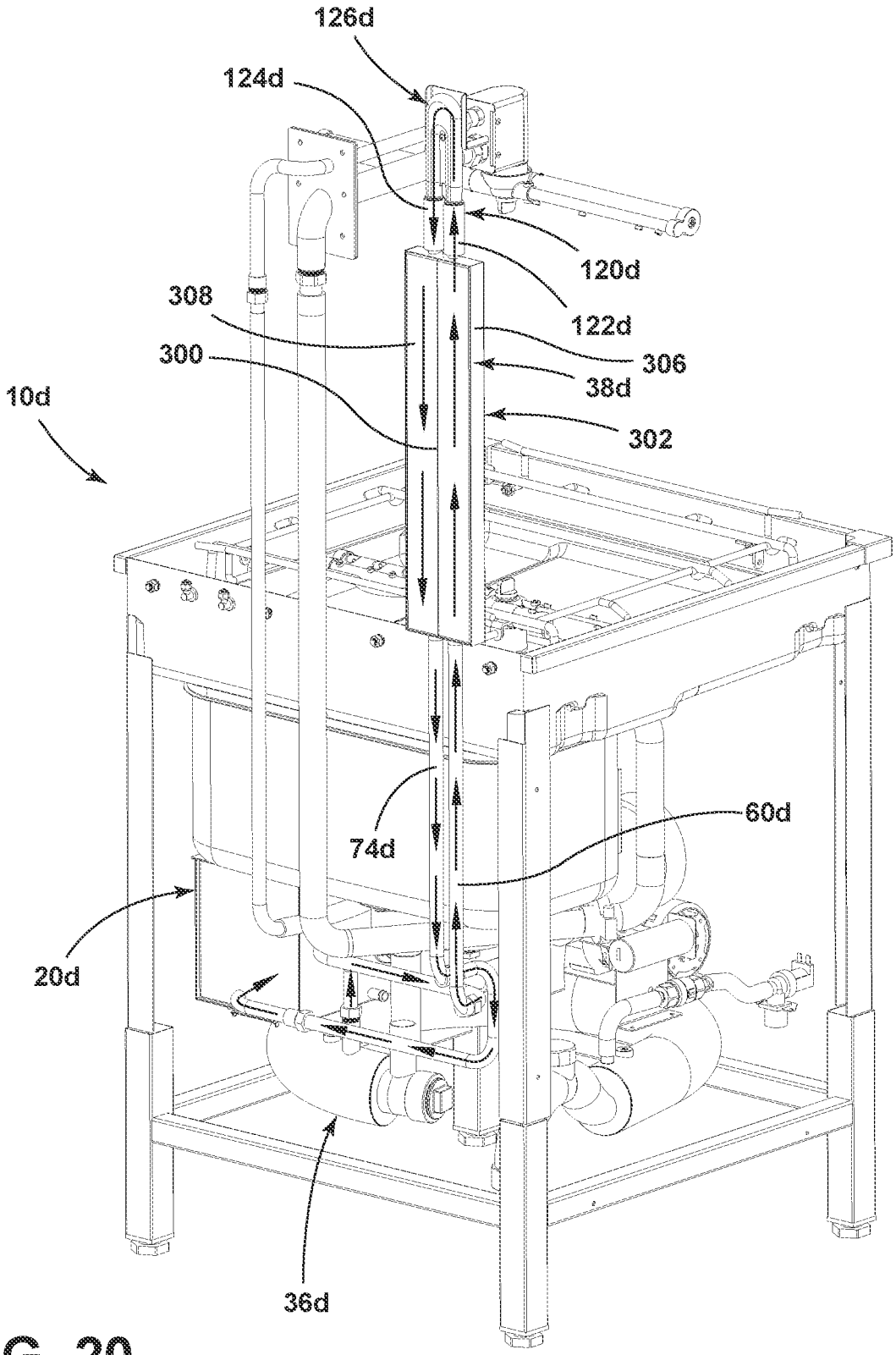
FIG. 20 is a second rear perspective view of the fourth embodiment of the dish washing machine according to an embodiment with walls and the door removed for reference.

In the illustrated example, the water exits the first path 306 of the heat exchanging panel 302 of the second heat exchange system 38*d* and passes into an up pipe 122*d* of an air gap system 120*d*. The air gap system 120*d* also includes an inverted U-Shaped connecter 126*d* that connects a top end of the up pipe 122*d* and transfers the water to a down pipe 124*d* as illustrated in FIGS. 19-20. The water then passes from the down pipe 124*d* and back into the second heat exchange system 38*d*.

The illustrated second heat exchange system 38*d* further heats the water from the air gap system 120*d* in the second path 308 of the heat exchanging panel 302. Like the heat transfer into the first path of the heat exchanging panel 302, heat from within the interior wash space 12*d* is passed to and through the rear wall 304 and the heat exchanging panel 302 to heat the water passing through the second path 308. The water heated in the second heat exchange system 38*d* exits the second path 308 and enters the second transfer pipe 76*c* for passage to the booster heating tank 20*d*. While the second heat exchange system 38*d* is shown as being the heat exchanging panel 302 that includes the first path 306 and the second path 308 separated by the dividing wall 300, it is contemplated that the second heat exchange system 38*d* could be a pair of separate panels abutting the rear wall 304 or a pair of pipes abutting the rear wall 304 for transferring heat in the interior wash space 12*d* to the water in the second heat exchange system 38*d*. The illustrated dish washing machine could include a combination of the first heat exchange system 36, 36*a*, 36*b*, 36*c* and 36*d* and/or the second heat exchange system 38, 38*a*, 38*b*, 38*c* and 38*d*. Moreover, it is contemplated that multiple second heat exchange systems could be used in combination with the first heat exchange system 36, 36*a*, 36*b*, 36*c* and 36*d*. For example, the second heat exchange systems 38*b*, 38*c* of the second and third embodiments of the dish washing machines 10*b*, 10*c*, respectively, could be used with any of the second heat exchange system 38 of the first embodiment of the dish washing machine 10, the second embodiment of the second heat exchange system 38*a* or the second heat exchange system 38*d* of the fourth embodiment of the dish washing machine 10*d*.

The dish washing machine as disclosed herein includes areas with heater liquid (e.g., the booster heating tank, the wash tank and the interior of the wash area) that transfer heat to water entering the system (e.g., before entering the booster heating tank). The heat exchange system can be installed inside the heat chamber (e.g., the second heat exchange systems 38, 38*a*), outside the heat chamber (e.g., the second heat exchange system 38*d*) or adjacent a hot zone (e.g., wash tank) of the dish washing machine (e.g., the second heat exchange systems 38*b*, 38*c*).

Figure 21:
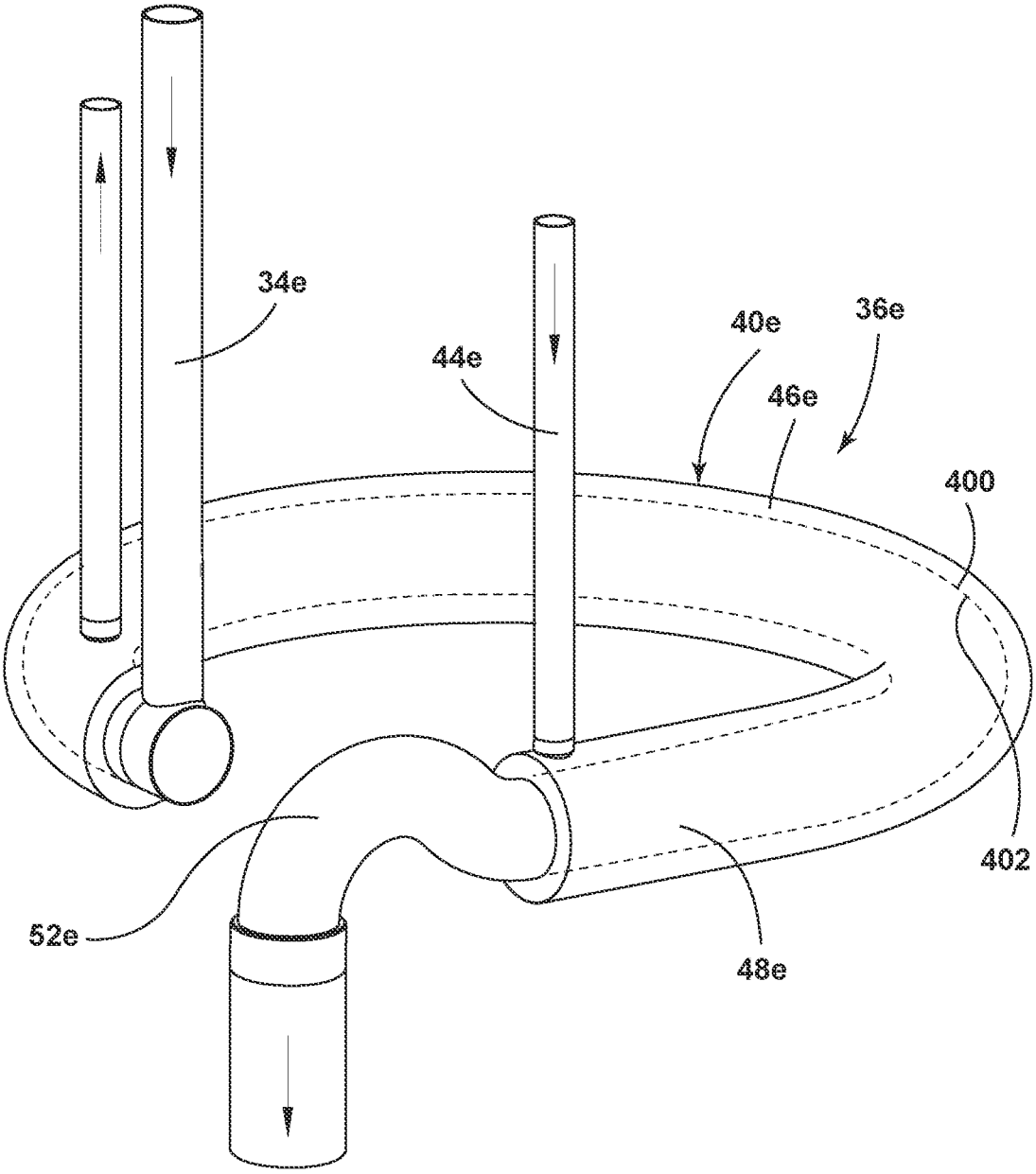
FIG. 21 is a perspective view of the first heat exchanger of the dish washing machine according to the fifth embodiment thereof.

The reference numeral 36*e* (FIG. 21) generally designates another embodiment of the present invention, having a fifth embodiment for the first heat exchange system. Since the fifth embodiment of the first heat exchange system is similar to the previously described second embodiment of the first heat exchange system 36*a*, similar parts appearing in FIGS. 10-13 and FIG. 21, respectively, are represented by the same, corresponding reference number, except for the suffix "e" in the numerals of the latter. The fifth embodiment of the first heat exchange system 36*e* can be substituted for any of the aforementioned first heat exchange systems 36, 36*a*, 36*b*, 36*c* and 36*d*. The fifth embodiment of the first heat exchange system 36*e* includes the heat exchange pipe 40*e* with the outer tube 46*e* and the inner or hot water exit tube 48*e*. The inner or hot water exit tube 48*e* exits at the bypass pipe 52*e*. As in the other embodiments of the present system, the bypass pipe 52*e* has a maximum height below the entrance to the drain pipe 34*e* (i.e., at the drain of the interior wash space) such that the bypass pipe 52*e* does not prevent the liquid in the interior wash space from draining out of the interior wash space and into the inner or hot water exit tube 48*e*.

In the illustrated embodiment, the fifth embodiment of the first heat exchange system 36*e* has a greater heat transfer coefficient than the other embodiments of the first heat exchange system. In the fifth embodiment of the first heat exchange system 36*e*, an outer surface 400 of the inner or hot water exit tube 48*e* has greater thermal conductivity than an inner surface 402 of the inner or hot water exit tube 48*e*. For example, the inner or hot water exit tube 48*e* can be formed of stainless steel with a plating (e.g., copper or silver) on the outer surface 400 thereof (e.g., by electroplating or chemical depositing). It is contemplated that other materials could be used with the outer surface 400 of the inner or hot water exit tube 48*e* having greater thermal conductivity than the inner surface 402 of the inner or hot water exit tube 48*e*.

In the fifth embodiment of the first heat exchange system 36*e*, the surface with the greater thermal conductivity is the outer surface 400 of the inner or hot water exit tube 48*e*, which is located within the outer tube 46*e*. However, it is contemplated that the inner tube 48*e* could have the clean water from the entrance pipe 44*e* running therethrough and the dirty liquid from the interior wash space running in an area between the inner tube 48*e* and the outer tube 46*e*. In such a configuration, the inner surface of the inner tube 48*e* would have the surface with the greater thermal conductivity (e.g., copper) on the inner surface of a stainless-steel pipe for the inner tube 48*e* and a stainless-steel pipe for the outer tube 46*e*.

In the fifth embodiment of the first heat exchange system 36*e*, the surface with the greater thermal conductivity contacts the clean water entering the system through the entrance pipe 44*e*. Therefore, the clean water will contact the surface with the greater thermal conductivity and the hot water exiting the system that contains alkali detergent and/or acidic rinse aid will contact a corrosive resistant surface (e.g., stainless-steel).

Although particular preferred embodiments of the invention have been disclosed in detail for illustrative purposes, it will be recognized that variations or modifications of the disclosed apparatus, including the rearrangement of parts, lie within the scope of the present invention. For example, it is contemplated that only a single rotating spray arm (upper or lower) could be used.

What is claimed is:

1. A dish washing machine comprising:

a housing having an interior wash space for washing dishes, the housing having a liquid inlet for adding a liquid to the dish washing machine and a liquid outlet for removing dirty liquid from the dish washing machine;

at least one spray nozzle for spraying the liquid onto dishes positioned within the interior wash space;

a heating tank for heating the liquid which is supplied to the at least one spray nozzle for spraying onto the dishes in the interior wash space; and at least one heat exchange system within the housing, the at least one heat exchange system transferring heat from the liquid heated by the heating tank to the liquid added to the dish washing machine from the liquid inlet;

the at least one heat exchange system includes a first heat exchange system comprising a pipe system defining a first path therethrough and a second path therethrough, with the first heat exchange system transferring heat from liquid in the second path to liquid in the first path;

the first path being located between the liquid inlet and the heating tank;

the second path being located between a drain for the interior wash space and the liquid outlet of the housing;

a first surface portion of the pipe system of the first path engaging the liquid in the first path having a greater thermal conductivity than a second surface portion of the pipe system of the second path engaging the liquid in the second path;

the pipe system comprising an inner pipe defining the second path therethrough and an outer pipe defining the first path between the inner pipe and the outer pipe; and the inner pipe being stainless steel with a copper coating on an outer surface thereof.

2. The dish washing machine of claim 1, wherein:

the pipe system is curved.

3. The dish washing machine of claim 1, wherein:

the outer pipe is stainless steel.

4. The dish washing machine of claim 1, wherein:

the liquid entering the dish washing machine passes sequentially from the liquid inlet, then to a second one of the at least one heat exchange system, then to the first heat exchange system and then to the heating tank.

5. The dish washing machine of claim 1, wherein:

wherein the first path and the second path have the same center of flow axis.

6. The dish washing machine of claim 1, wherein:

wherein the first path surrounds the second path.

7. The dish washing machine of claim 1, further including:

a bypass line located between the second path and the liquid outlet, the bypass line being located at a bypass height higher than a second path height of the second path but lower than a drain height of the drain for the interior wash space, the bypass line maintaining liquid in the second path by a force of gravity.

8. The dish washing machine of claim 7, further including:

a flow control for selectively maintaining liquid in the second path or allowing the liquid to flow to the liquid outlet, the bypass line bypassing the flow control, the flow control, when opened, allowing the liquid to flow to the liquid outlet without first passing through the bypass line.

9. A dish washing machine comprising:

a housing having an interior wash space for washing dishes, the housing having a liquid inlet for adding a liquid to the dish washing machine and a liquid outlet for removing dirty liquid from the dish washing machine;

at least one spray nozzle for spraying the liquid onto dishes positioned within the interior wash space;

a heating tank for heating the liquid which is supplied to the at least one spray nozzle for spraying onto the dishes in the interior wash space;

at least one heat exchange system within the housing, the at least one heat exchange system transferring heat from the liquid heated by the heating tank to the liquid added to the dish washing machine from the liquid inlet;

the at least one heat exchange system includes a first heat exchange system comprising a pipe system comprising an inner pipe and an outer pipe, the pipe system defining a first path between the inner pipe and the outer pipe, the pipe system also defining a second path within the inner pipe, with the first heat exchange system transferring heat from liquid in the second path to liquid in the first path;

the first path being located between the liquid inlet and the heating tank;

the second path being located between a drain for the interior wash space and the liquid outlet of the housing; and an outer surface of the inner pipe having a greater thermal conductivity than an inner surface of the inner pipe;

the inner pipe being stainless steel with a copper coating on the outer surface thereof.

10. The dish washing machine of claim 9, wherein:

the pipe system is curved.

11. The dish washing machine of claim 9, wherein:

the outer pipe is stainless steel.

12. The dish washing machine of claim 9, wherein:

the liquid entering the dish washing machine passes sequentially from the liquid inlet, then to a second one of the at least one heat exchange system, then to the first heat exchange system and then to the heating tank.

13. The dish washing machine of claim 9, wherein:

wherein the first path and the second path have the same center of flow axis.

14. The dish washing machine of claim 9, further including:

a bypass line located between the second path and the liquid outlet, the bypass line being located at a bypass height higher than a second path height of the second path but lower than a drain height of the drain for the interior wash space, the bypass line maintaining liquid in the second path by a force of gravity.

15. The dish washing machine of claim 14, further including:

a flow control for selectively maintaining liquid in the second path or allowing the liquid to flow to the liquid outlet, the bypass line bypassing the flow control, the flow control, when opened, allowing the liquid to flow to the liquid outlet without first passing through the bypass line.

* * * * *